US010741914B2

(12) United States Patent
Vouvakis et al.

(10) Patent No.: US 10,741,914 B2
(45) Date of Patent: Aug. 11, 2020

(54) PLANAR ULTRAWIDEBAND MODULAR ANTENNA ARRAY HAVING IMPROVED BANDWIDTH

(71) Applicants: UNIVERSITY OF MASSACHUSETTS, Boston, MA (US); THE GOVERNMENT OF THE UNITED STATES OF AMERICA AS REPRESENTED BY THE SECRETARY OF THE NAVY, Arlington, VA (US)

(72) Inventors: Marinos N. Vouvakis, Amherst, MA (US); Rick W. Kindt, Arlington, VA (US); John T. Logan, Warwick, RI (US)

(73) Assignees: UNIVERSITY OF MASSACHUSETTS, Boston, MA (US); THE GOVERNMENT OF THE UNITED STATES OF AMERICA, AS REPRESENTED BY THE SECRETARY OF THE NAVY, Arlington, VA (US)

( * ) Notice: Subject to any disclaimer, the term of this patent is extended or adjusted under 35 U.S.C. 154(b) by 42 days.

(21) Appl. No.: 15/553,064

(22) PCT Filed: Feb. 25, 2016

(86) PCT No.: PCT/US2016/019569
§ 371 (c)(1),
(2) Date: Aug. 23, 2017

(87) PCT Pub. No.: WO2016/138267
PCT Pub. Date: Sep. 1, 2016

(65) Prior Publication Data
US 2018/0040955 A1 Feb. 8, 2018

Related U.S. Application Data

(60) Provisional application No. 62/121,055, filed on Feb. 26, 2015.

(51) Int. Cl.
*H01Q 5/25* (2015.01)
*H01Q 5/42* (2015.01)
(Continued)

(52) U.S. Cl.
CPC ..... *H01Q 5/25* (2015.01); *H01Q 5/42* (2015.01); *H01Q 5/48* (2015.01); *H01Q 9/065* (2013.01);
(Continued)

(58) Field of Classification Search
CPC .. H01Q 5/25; H01Q 5/42; H01Q 5/48; H01Q 5/50; H01Q 9/065; H01Q 9/285;
(Continued)

(56) References Cited

U.S. PATENT DOCUMENTS 6,323,809 B1 11/2001 Maloney et al.
6,512,487 B1 1/2003 Taylor et al.
(Continued)

OTHER PUBLICATIONS

International Search Report and Written Opinion for application No. PCT/US16/19569 dated Jul. 18, 2016.
(Continued)

*Primary Examiner* — Daniel Munoz
*Assistant Examiner* — Patrick R Holecek
(74) *Attorney, Agent, or Firm* — Renner, Otto, Boisselle & Sklar, LLP

(57) ABSTRACT

Structures and configurations for planar ultrawideband modular antenna arrays. One example of a PUMA array includes an unbalanced RF interface, a lattice of horizontal dipole segments directly fed with the unbalanced RF interface, the lattice being arranged in either a dual-offset dual-
(Continued)

polarized configuration or a single-polarization configuration, and a metallic plate capacitively-coupled to the lattice of horizontal dipole segments and pinned to a ground plane with a first plated via.

12 Claims, 26 Drawing Sheets

(51) Int. Cl.

| | |
|---|---|
| ***H01Q 5/48*** | (2015.01) |
| ***H01Q 9/28*** | (2006.01) |
| ***H01Q 21/24*** | (2006.01) |
| ***H01Q 21/06*** | (2006.01) |
| ***H01Q 9/06*** | (2006.01) |

(52) U.S. Cl.
CPC ..... *H01Q 9/285* (2013.01); *H01Q 21/062* (2013.01); *H01Q 21/24* (2013.01)

(58) Field of Classification Search
CPC ..... H01Q 21/062; H01Q 21/24; H01Q 21/26; H01Q 21/29; H01Q 21/293
See application file for complete search history.

(56) References Cited

U.S. PATENT DOCUMENTS

| | | | | |
|---|---|---|---|---|
| 8,325,093 | B2 * | 12/2012 | Holland | H01P 5/10 343/700 MS |
| 9,172,147 | B1 * | 10/2015 | Manry, Jr. | H01Q 1/286 |
| 2008/0246680 | A1 | 10/2008 | Rawnick et al. | |
| 2010/0007572 | A1 | 1/2010 | Jones et al. | |
| 2010/0109966 | A1 | 5/2010 | Mateychuk et al. | |
| 2012/0146869 | A1 * | 6/2012 | Holland | H01P 5/10 343/795 |
| 2013/0321231 | A1 | 12/2013 | Flores-Cuadras | |

OTHER PUBLICATIONS

Logan et al. "Planar Ultrawideband Modular Antenna (PUMA) Arrays Scalable to mm-Waves", IEEE Antennas and Propagation Society International Symposium (2013), p. 624-625.

Guo et al. "Broadband 60-GHz Beam-Steering Vertical Off-Center Dipole Antennas in LTCC", IEEE International Workshop on Antenna Technology (2012), pp. 177-180.

Extended European Search Report in Application No. PCT/US2016/019569 dated Aug. 27, 2018.

* cited by examiner

PLANAR ULTRAWIDEBAND MODULAR ANTENNA ARRAY HAVING IMPROVED BANDWIDTH

CROSS-REFERENCE TO RELATED APPLICATIONS

This application claims priority to and the benefit under 35 U.S.C. § 119(e) of U.S. Provisional Application No. 62/121,055 titled "IMPROVED BANDWIDTH PLANAR ULTRAWIDEBAND MODULAR ANTENNA ARRAY" and filed on Feb. 26, 2015, which is herein incorporated by reference in its entirety for all purposes.

FEDERALLY SPONSORED RESEARCH

This invention was made with government support under grant No. N00173-13-1-G015 awarded by the Naval Research Laboratory. The U.S. government has certain rights in the invention.

FIELD OF THE INVENTION

Aspects and embodiments relate generally to antennas, antenna arrays, ultrawideband (UWB) wireless communication systems, remote sensing, RADARs, electronic warfare, and multifunctional systems.

BACKGROUND

Ultrawideband electronically scanned arrays (UWB-ESAs) with polarization agility and wide-scan performance remain as a key component in programmable and multifunctional RF front-end systems. Additionally, UWB-ESAs are desirable for use in high-throughput wireless communication systems, high-resolution radar applications, electronic countermeasures, and radio astronomy. However, conventional UWB-ESA technologies are expensive and challenging to fabricate, assemble, and maintain due to non-planar geometries that require vertical integration and the use of external feeding parts such as feed organizers and baluns or hybrid circuits, for example.

Planar UWB-ESA technologies are appealing due to their simplicity, low-cost fabrication, ease of integration, and low-profile. U.S. Pat. No. 6,512,487, for example, discloses a sheet antenna (CSA) array that was among the first planar UWB-ESAs capable of achieving up to 9:1 (high-to-low frequency ratio) bandwidths in a dual-polarized arrangement by using a coincident phase center fed capacitively coupled horizontal dipoles above a ground plane. Other planar arrays such as the fragmented aperture array (FAA; an example of which is disclosed in U.S. Pat. No. 6,323,809), long slot arrays, and thumbtack arrays use connected electric or "magnetic" elements that, when radiating in free space and infinite array configurations, yield infinite bandwidth. To produce unidirectional radiation, a ground plane is introduced that inevitably engenders resonances, and thus lossy screens or frequency selective surfaces, and R-card are introduced between the array and the ground plane to suppress them at the expense of some gain loss, efficiency reduction, and increases in antenna temperature.

Despite exhibiting some satisfactory UWB radiation properties, these conventional UWB-ESAs can be costly, and impossible to manufacture for operation at millimeter-wave (mm-wave) frequencies. ESAs typically include very large, dense two-dimensional grids of periodically-spaced radiators (e.g., 100-70,000 elements). Such large grids of, often complex, radiator elements are impossible to fabricate in one piece. Consequently, assembly from individual elements by pick-and-place is time-consuming or often inhibited due to electrical connection requirements between elements. Accordingly, a modular tile-based design that allows integration of a moderate number of elements in one tile followed by the modular assembly of such tiles would be preferable. In addition, all conventional UWB-ESAs rely on multiple manufacturing technologies (hybrid manufacturing) at different build stages, for example, planar fabrication combined with CNC or EDM machining or 3D printing. These technologies have different tolerances and part size limitations that ultimately prohibit UWB-ESA scalability to higher frequencies, including newly released spectrum bands at EHF mm-waves (30-300 GHz). Related to cost, frequency scalability and electrical performance is the reliance of all conventional UWB-ESAs upon external circuitry such as feed-organizers, wideband passive or active baluns, and/or wideband hybrids. All of these are difficult to integrate to the ESA aperture, can be large and bulky or lossy, and increase cost and weight/profile, while compromising electrical performance.

To circumvent these difficulties, the Planar Ultrawideband Modular Antenna (PUMA) array was developed in 2008 to provide a fully planar, modular UWB array technology, as disclosed in U.S. Pat. No. 8,325,093, for example. Unlike other dual-polarized UWB-ESAs, the PUMA array is fully manufactured with planar etched circuits and plated vias without the use of external baluns/hybrids and feed organizers to allow for a simple, low-cost multilayer PCB fabrication process. The dipole array layer is comprised of planar, horizontal metallic traces fed by non-blind plated vias, where one pin connects a segment to the ground plane and the other connects an adjacent segment to the active fed wire. This simplified construction is based on an unbalanced feed-line scheme that uses an additional plated via to connect the fed horizontal trace to the ground plane, effectively enabling direct connection to standard RF interfaces by mitigating common-modes that would otherwise develop within the operating band at broadside scanning conditions. This feeding additionally allows for modular, tile-based assembly due to the dual-offset egg-crate lattice arrangement and lack of external circuitry. Some examples of such an array demonstrated low VSWR and good scan performance out to 45 degrees over a 3:1 instantaneous bandwidth up to 21 GHz.

Despite exhibiting strong performance with a simple design, the bandwidth of the type of UWB-ESA disclosed in U.S. Pat. No. 8,325,093, for example, was limited to 3:1. This limit is inherently imposed by loop modes spurring from the introduction of the additional plated via on each fed dipole arm. To overcome this, a planar matching network was printed on the opposite side of the ground plane, which effectively boosted the instantaneous bandwidth up to 5:1 in simulations, as described in S. S. Holland and M. N. Vouvakis, "The Planar Ultrawideband Modular Antenna (PUMA) Array," *IEEE Trans. Antennas Propag.*, vol. 60, pp. 130-140, January 2012. Although the bandwidth was improved to approximately 5:1, such matching network usage restricted the operation to frequencies up to approximately 5 GHz.

Thus, although certain PUMA arrays may provide a low-cost, modular UWB-ESA solution as compared to conventional UWB-ESAs, these PUMA arrays exhibit comparatively low instantaneous bandwidth despite their convenient fabrication and assembly benefits.

SUMMARY OF THE INVENTION

Aspects and embodiments are directed to a new class of Planar Ultrawideband Modular Antenna (PUMA) arrays with enhanced bandwidth and frequency scalability potential achieved at least in part through the implementation of new architectural features. As a member of the PUMA class, embodiments of the array are modular and use a dual-offset dual-polarized lattice of horizontal segments directly fed with a standard unbalanced RF interface. However, there are several significant structural differences as compared to conventional PUMA arrays. For example, the plated vias which in a conventional PUMA array directly connect the fed radiating arms of the array to the ground plane are removed, and instead a metallic plate is capacitively coupled to the dipole segments and pined to the ground plane with a plated via, as discussed in more detail below. This implementation of a PUMA array avoids the induction of low-frequency limiting loop modes that are prevalent in conventional PUMA arrays, while also mitigating disruptive common-modes. The conventional PUMA array may be considered as a limiting case of the feed being directly shorted/looped back to ground, whereas certain aspects and embodiments use different arrangements of vias, as discussed further below, to allow for a more broad interpretation of the PUMA concept in which the feed arm of the radiator can be more selectively looped back to ground using tuned circuitry (such as capacitors).

Additionally, according to certain embodiments, metallic ribs are attached to the fed and grounded lines beneath the horizontal dipole segments and oriented towards one another to enhance capacitive coupling and improve impedance performance in the transition from the feed circuits to the dipole traces. The heightened capacitance between the dipoles and feed lines also enables wider trace-trace gaps, via-to-via distances, via diameter-to-height aspect ratios, and thicker dielectric materials to be utilized that satisfy PCB standard manufacturing tolerances up to approximately Q-band (50 GHz).

Due to these simple yet innovative new features, embodiments of the PUMA arrays disclosed herein retain the practical mechanical benefits of conventional PUMA arrays (e.g., modularity, direct unbalanced feeding, planar fabrication, low-profile, etc.) while doubling the bandwidth (3:1 to 6:1) to yield a fractional bandwidth of 143% (as opposed to 100%). An additional attractive feature of the PUMA array according to certain aspects and embodiments is that its frequency operation can extend up to the grading lobe frequency (i.e. $D_x=D_y=\lambda/2$ for scanned arrays, where $D_x$ and $D_y$ are the array periodicity in the lateral dimension and $\lambda$ is the free space wavelength), thus optimally sampling the array aperture, which implies the use of the least number of elements and electronics. The fully planar topology of embodiments of the PUMA arrays disclosed herein enables standard microwave/millimeter-wave fabrication to produce low-cost, low-profile ($\lambda_h/2$, where $\lambda_h$ is the highest frequency wavelength), modular UWB-ESAs with a competitive 6:1 bandwidth.

According to one embodiment, a PUMA array having enhanced bandwidth and frequency scalability comprises an unbalanced RF interface, a dual-offset dual-polarized lattice of horizontal dipole segments directly fed with the unbalanced RF interface, and a metallic plate capacitively-coupled to the lattice of horizontal dipole segments and pinned to ground with a plated via.

According to another embodiment, PUMA array comprises an unbalanced RF interface, a dual-offset dual-polarized lattice of horizontal dipole segments directly fed with the unbalanced RF interface, and a metallic plate capacitively-coupled to the lattice of horizontal dipole segments and pinned to a ground plane with a first plated via.

In one example the metallic plate is registered below the lattice of horizontal dipole segments. In another example the dual-offset dual-polarized lattice of horizontal dipole segments includes a first plurality of horizontal dipole segments and a second plurality of horizontal dipole segments, each horizontal dipole segment of the first plurality of horizontal dipole segments being connected to the unbalanced RF interface by a second plated via, and each horizontal dipole segment of the second plurality of horizontal dipole segments being directly connected to the ground plane by a third plated via, the second and third plated vias providing a feed transmission line to excite the dual-offset dual-polarized lattice of horizontal dipole segments. In certain examples the dipole segments are asymmetric. For example, the excited (fed or "hot") dipole segment can be is larger/longer than the grounded (passive) dipole segment. The PUMA array may further comprise a multi-layer substrate having a first planar surface and an opposing second planar surface, the ground plane being disposed on the first planar surface and the first and second pluralities of horizontal dipole segments being disposed on the second planar surface such that the multi-layer substrate is sandwiched between the dual-offset dual-polarized lattice of horizontal dipole segments and the ground plane, the second and third plated vias extending through the multi-layer substrate. In one example a thickness of the multi-layer substrate is selected such that the first and second pluralities of horizontal dipole segments are separated from the ground plane by a distance of approximately one quarter of a wavelength at the highest operating frequency of the PUMA array. The PUMA array may further comprise a plurality of superstrate dielectric layers disposed over the dual-offset dual-polarized lattice of horizontal dipole segments. In one example the multi-layer substrate includes a first dielectric layer, a second dielectric layer disposed above the first dielectric layer, and a third dielectric layer disposed above the second dielectric layer, the first surface being a lower surface of the first dielectric layer, and the second surface being an upper surface of the third dielectric layer. In one example the PUMA array may further comprise a first pair of ribs electrically connected to the second plated via and a second pair of ribs electrically connected to the third plated via, the first and second pairs of ribs being oriented to face towards one another, and each of the first and second pairs of ribs including a first rib disposed on an upper surface of the first dielectric layer and a second rib disposed on an upper surface of the second dielectric layer. In another example the PUMA array may further comprise a first plurality of horizontal metallic ribs electrically connected to the second plated via, and a second plurality of horizontal metallic ribs electrically connected to the third plated via, the first and second pluralities of horizontal metallic ribs being oriented to face towards one another. The metallic plate can have a shape that is any one of square, rectangular, circular, oval, double tip asymmetric ogive, or any other arbitrary shape.

According to another embodiment, a PUMA array comprises an unbalanced RF interface, and an array of unit cells formed on a multi-layer substrate and fed by the unbalanced RF interface. Each unit cell in the array includes a first radiator directly connected to a feed input by a first plated via, a second radiator directly connected to a ground plane by a second plated via, the ground plane being disposed on a first surface of the multi-layer substrate and the first and second radiators being disposed on a second opposing surface of the multi-layer substrate such that the multi-layer substrate is sandwiched between the ground plane and the first and second radiators, and a metallic plate capacitively-coupled to the first and second radiators and connected to the ground plane by a third plated via.

In one example the array of unit cells is arranged as a dual-offset dual-polarized array, and wherein the first and second radiators of each unit cell are horizontal dipoles. In one example the first plated via is disposed at an edge of the first radiator, the second plated via is disposed at an edge of the second radiator, and the first and second radiators extend towards one another from the first and second plated vias, respectively, such that tips of the first and second radiators are separated from one another by a predetermined gap. In another example the metallic plate is disposed on a surface of an intermediate dielectric layer of the multi-layer substrate and registered below the first and second radiators, such that the metallic plate is positioned between the ground plane and the first and second radiators. In another example the metallic plate is approximately centered below a centerline of the gap between the tips of the first and second radiators. Each unit cell may further comprise at least one first metallic rib electrically connected to the first plated via and at least one second metallic rib electrically connected to the second plated via, the at least one first metallic rib and the at least one second metallic rib oriented to face one another. In one example the multi-layer substrate includes a first dielectric layer, a second dielectric layer disposed above the first dielectric layer, the intermediate dielectric layer disposed above the second dielectric layer, and a third dielectric layer disposed above the intermediate dielectric layer, wherein the at least one first metallic rib includes a pair of horizontal first ribs disposed on upper surfaces of the first and second dielectric layers, respectively, and wherein the at least one second metallic rib includes a pair of horizontal second ribs disposed on the upper surfaces of the first and second dielectric layers, respectively. In another example a thickness of the multi-layer substrate is selected such that the first and second radiators are separated from the ground plane by a distance of approximately one quarter of a wavelength at the highest operating frequency of the PUMA array. In another example the PUMA array may further comprise a dielectric layer disposed over the first and second radiators, and wherein the metallic plate is disposed on a surface of the dielectric layer, the third plated via extending through the dielectric layer and the multi-layer substrate from the metallic plate to the ground plane.

Still other aspects, embodiments, and advantages of these exemplary aspects and embodiments are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the invention. In the figures, each identical or nearly identical component that is illustrated in various figures is represented by a like numeral. For purposes of clarity, not every component may be labeled in every figure. In the figures.

DETAILED DESCRIPTION

Aspects and embodiments are directed to a new class of Planar Ultrawideband Modular Antenna (PUMA) arrays with enhanced bandwidth and frequency scalability potential. In particular, certain embodiments provide a PUMA array with double the bandwidth as compared to a conventional PUMA array of similar size and similar type of feeding circuitry. This increase in bandwidth is achieved through implementation of various unique architectural features, as discussed in more detail below. Furthermore embodiments of the array remain simple to fabricate using standard microwave fabrication techniques up to EHF (mm-wave) frequency bands, while providing significant performance enhancements over conventional PUMA arrays. When advanced manufacturing technologies such as lithographic processing on hard substrates are used, some PUMA array features such as printing art and vias can be placed closer thus embodiments of the PUMA array disclosed herein can be manufactured up to frequencies that exceed 180 GHz. Contrary, at the expense of additional assembly, embodiments of the PUMA array disclosed herein can be manufactured below UHF frequencies using vertically integrating PCB cards that contain the printed feed vias with thumbtacks that are used to embody the plate-caped via structure with a planar layer that contains the printed dipole arms.

Figure 1A:
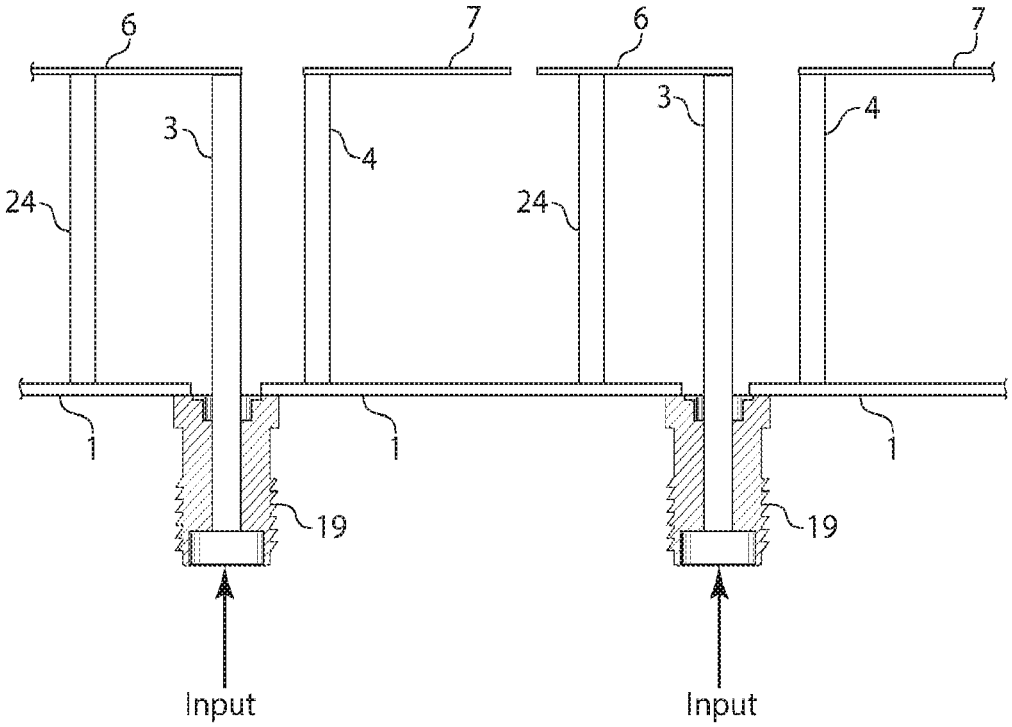
Fig. 1A (Related Art)
FIG. 1A is a diagram illustrating an example of a feeding method for a conventional PUMA.

As discussed above, the conventional PUMA array eliminated the need for external circuitry through the use of a balun that introduced a hard 3:1 bandwidth limitation due to additional grounding of the radiating arms. Referring to FIG. 1A, there is illustrated a portion of a conventional PUMA array including printed arms 6 and 7. A plated via 4 is used to directly connect PUMA arm 7 to a ground plane 1, and another plated via 3 connects the other PUMA arm 6 to the inner-conductor of a standard RF connector 19. Together, the plated (metallic) vias 3 and 4 function as vertical transmission lines to excite the radiating printed arms 6 and 7. Additional plated vias 24 directly connect the fed horizontal segment of PUMA arm 6 to the ground plane 1. In the conventional PUMA configuration as shown in FIG. 1A, the direct-connection balun provided by vias 24 is necessary to prevent a disruptive common mode from developing on the feed lines of plated vias 3 and 4—the same common mode that the former CSA and FAA arrays discussed above suppress using non-planar feed organizers and external circuitry i.e. baluns. This prevented further enhancement of the conventional PUMA array in terms of bandwidth, despite its mechanical and fabrication advantages.

Figure 1B:
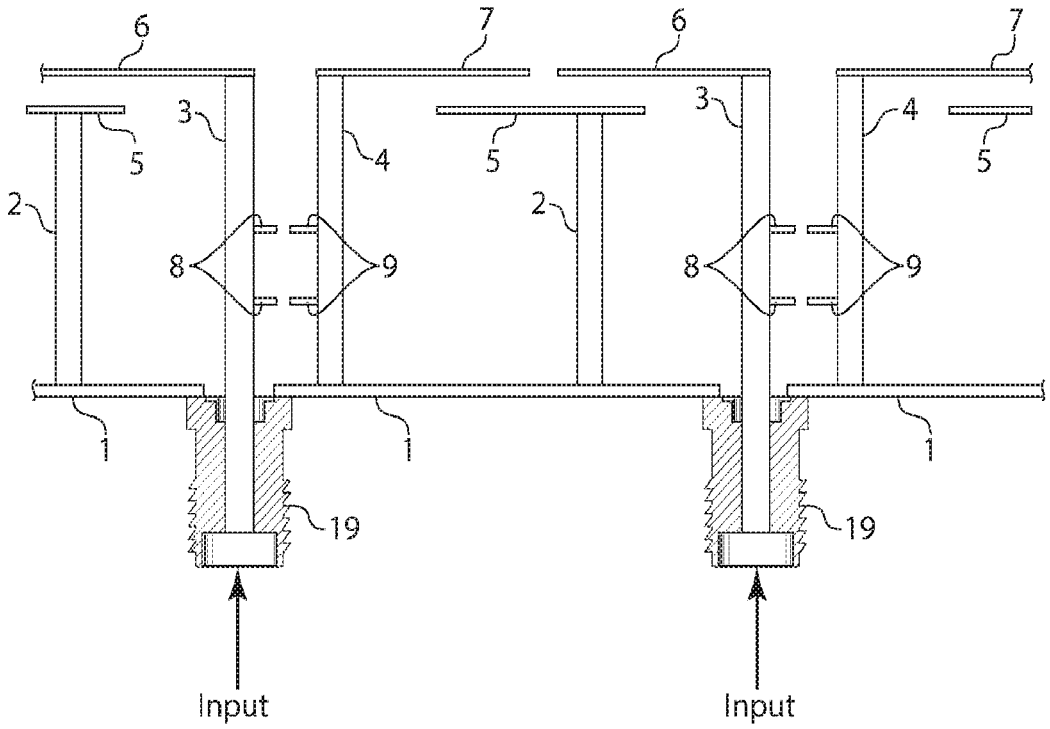
FIG. 1B is a diagram illustrating an example of a feeding method for embodiments of an improved bandwidth PUMA according to aspects of the present invention.

Aspects and embodiments of the new PUMA arrays disclosed herein retain all the practical and mechanical advantages of conventional PUMA arrays, but considerably enhance the electrical performance and frequency scalability by overcoming the limitations of conventional PUMA array through the incorporation of various structural features. In particular, certain embodiments avoid the need for the vias 24 present in the conventional PUMA, instead replacing them with the use of a capacitively-coupled via structure and mechanism, as shown in FIG. 1B, for example, for common-mode mitigation without bandwidth limitations. Certain examples further include a capacitive plate for enhanced low-end bandwidth and relaxed fabrication tolerances, as discussed further below. Additionally, feed line ribs can be included for improved overall matching and relaxed fabrication tolerances, as also discussed below.

Referring to FIG. 1B, there is illustrated a portion of a PUMA array according to one embodiment in which the plated vias 24 of the conventional array have been removed and replaced instead with a metallic plate 5. The plate 5 is capacitively coupled to the fed PUMA arms 6 and 7 and is pinned to the ground plane 1 by plated vias 2. The metallic plate 5 is registered beneath (or above in some embodiments) the PUMA arms 6 and 7 spaced at a distance specific to each particular embodiment and frequency operation. Device performance can be tuned by the shape and placement of this metallic plate 5 and pinned via 1 based on how the plate and pinned via couples to the feed and ground arms of the PUMA. Plated vias 3 and 4 are utilized to form a vertical two-wire transmission line that brings the RF signal from the unbalanced RF connector or transmission line to the PUMA arms. In one example, one via (4) is directly connected to the ground plane 1 and the other (3) to the signal terminal of the RF transmission line (coaxial cable, stripline, microstrip, etc.). It is noted that via 3 not need to be directly connected to PUMA arm 6; however, in this case strong capacitive coupling between via 3 and arm 6 are required for appropriate operation. The plated via 2 may be used to directly connect the metallic plate 5 to the ground plane 1. Additionally, in some embodiments, metallic "ribs" 8 and 9 are attached to the feed and grounded lines, respectively, beneath the horizontal PUMA arm segments 6 and 7. Thus, the feed lines may be drilled through multiple layers to make connection with not only the PUMA arms, but also to two or more metallic ribs 8 and 9 printed on dielectric layers underneath the PUMA arm metallization layer, as discussed further below. The metallic ribs 8 and 9 are oriented towards one another to enhance capacitive coupling and improve impedance performance in the transition from the feed circuits to the PUMA arms. The heightened capacitance between the PUMA arms and feed lines also allows wider feed via-to-via gaps and larger feed via, i.e. via 3 and 4 aspect ratios to be utilized that satisfy PCB standard manufacturing tolerances up to approximately Q-band (50 GHz). Furthermore, certain embodiments implement a capacitively-coupled feed line via 3 with no direct connection to feed components, as discussed below.

Figure 2A:
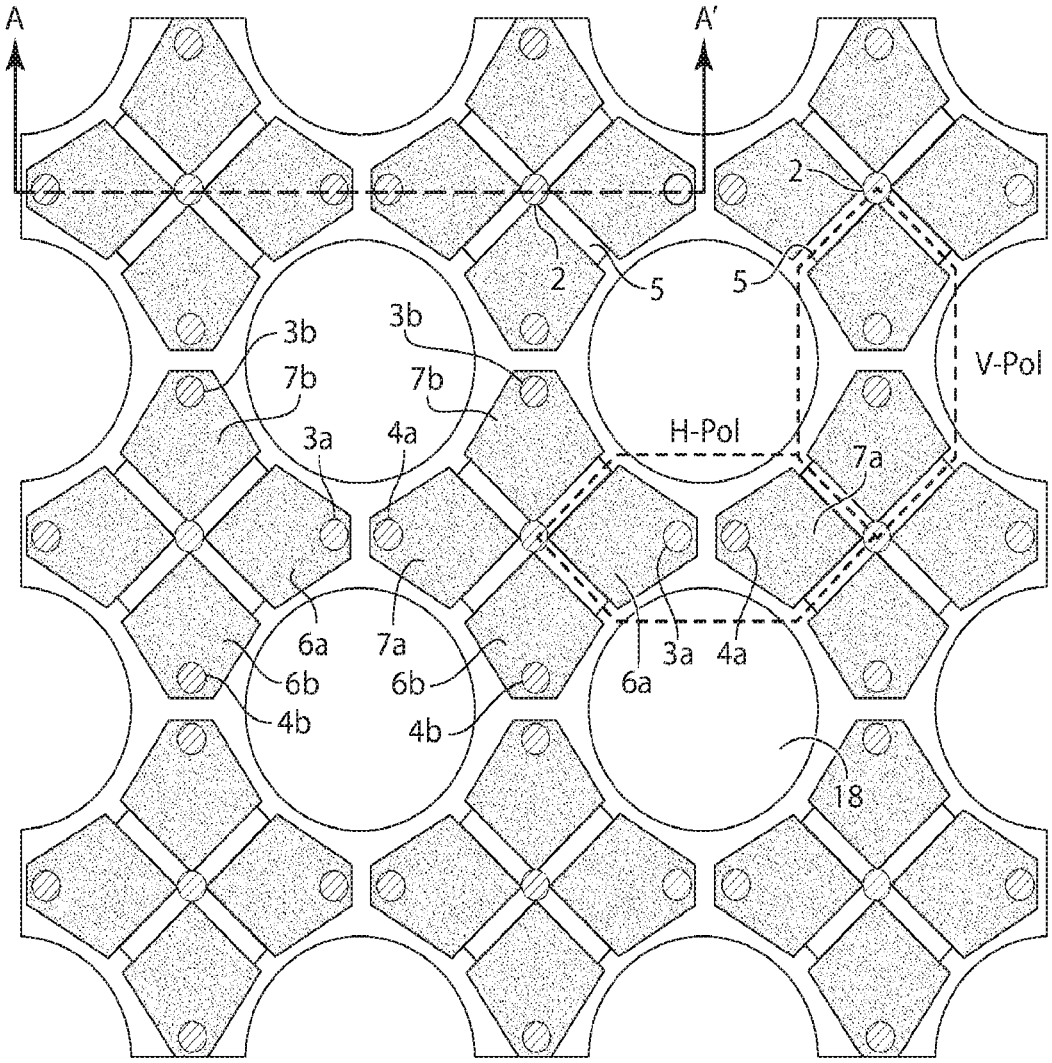
FIGS. 2A-C are topological viewpoints of examples of a PUMA according to aspects of the invention, with FIG. 2A showing a top view of a 3×3×2 tile, FIG. 2B showing a cross-section of a 2×1×2 tile, taken along line A-A' in FIG. 2A with module split plane between feed lines, and FIG. 2C showing a cross-section of a 2×1×2 tile taken along line A-A' in FIG. 2A, with module split plane between radiator arm tips.
Figure 2B:
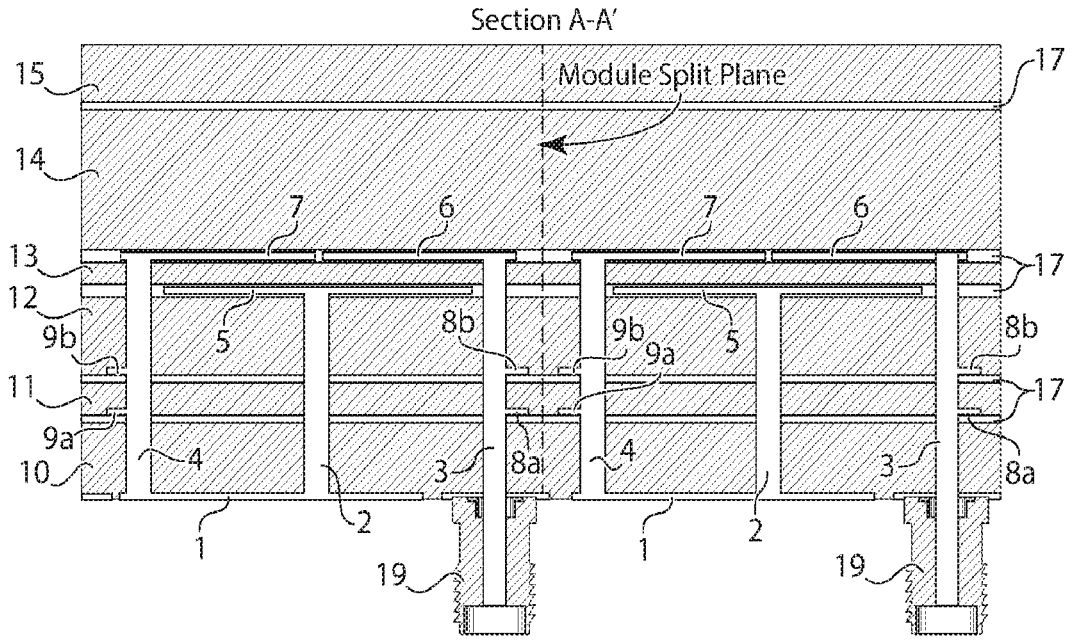
Figure 2C:
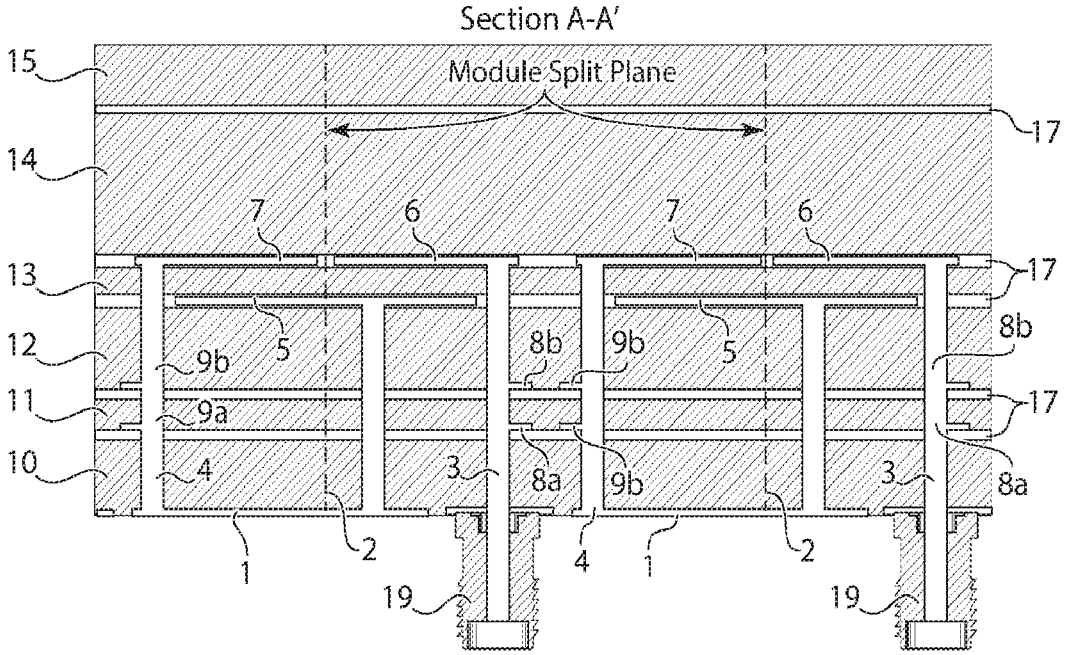
Figure 3A:
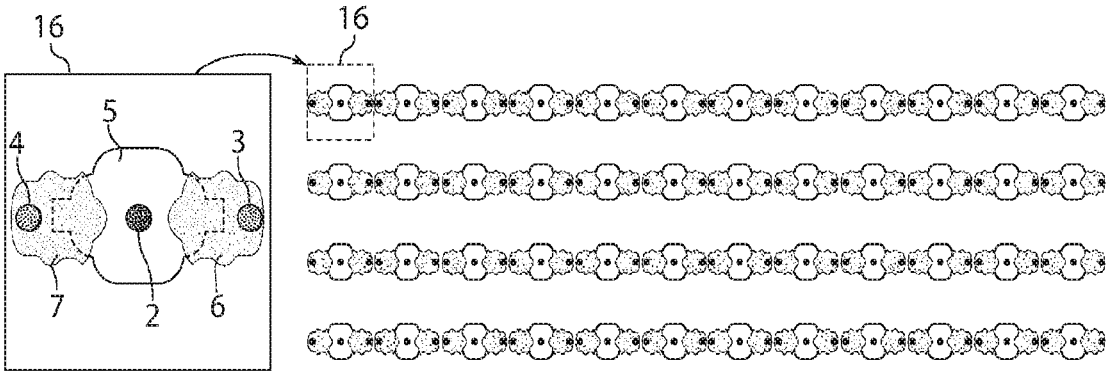
FIG. 3A is a top view of one example of PUMA elements with via connections for a single polarized configuration, according to aspects of the present invention.
Figure 3B:
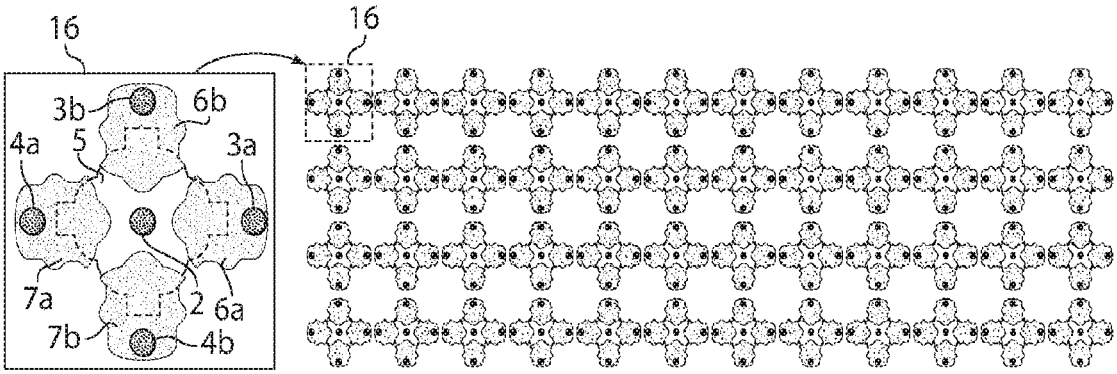
FIG. 3B is a top view of one example of PUMA elements with via connections for a dual polarized egg-crate configuration, according to aspects of the present invention.

As is the case for conventional PUMA arrays, PUMA elements in accord with aspects and embodiments of the present invention may be used in both single and dual-offset, dual polarized "egg-crate" array configurations, have completely planar and modular fabrication/assembly, and directly interface with standard RF interfaces (SMA, SMP, G3PO, etc. connectors). Certain embodiments use a dual-offset dual-polarized lattice of horizontal segments directly fed with a standard unbalanced RF interface, as shown in FIG. 2A, for example. In a dual-polarized embodiment, such as that shown in FIG. 2A, the elements are arranged periodically in a dual-offset, dual-polarized rectangular grid; however, in other embodiments, a simplified single-polarization configuration can be used. Element spacing in principal plane directions is typically half a wavelength at the highest frequency of operation to avoid the onset of grating lobes within the scan volume. The shape of the PUMA radiator arms can take on several forms and the two dipole arms do not need to be symmetric, as discussed further below. FIGS. 3A and 3B illustrate non-limiting examples of shapes of the PUMA radiator arms for single- and dual-polarized arrangements, respectively; however, numerous other configurations may be implemented. The PUMA arms may be printed atop a multilayer dielectric stack-up that can host plated vias and other metallization layers as shown in FIG. 2B, for example, as discussed further below. The multilayer dielectric is preferably bonded to one, two or even three cover layers (superstrates) and the resulting stack-up may be perforated to remove material at the regions around the dipole metallization. A module split plane to enable modular tiling is marked between the PUMA feed lines and the PUMA radiator arms as shown in FIGS. 2B and 2C, respectively.

Although the element topology disclosed herein may be considered simple, it may provide significant benefits. For example, similar two-lead vertical transmission line structures lacking certain aspects of the present invention would require an external balun to maintain differential currents on the feed lines over a wide bandwidth to prevent a problematic common mode from developing within the operating band. In addition, feed organizers to shield the vertical transmission lines would be necessary to prevent scan-induced resonances. As discussed above, conventional PUMA arrays addressed this issue by integrating a balun within the element through directly connecting its excited PUMA arm to the ground plane (using vias 24 as shown in FIG. 1A). In doing so, the common mode that would have developed within the operating band due to the unbalanced feeding is pushed above the high-frequency band-edge. However, as an artifact of this balun design, the low-end bandwidth potential is inherently limited due to the grounding of the excited PUMA arm.

Certain aspects and embodiments of the present invention integrate a new balun structure (namely a capacitively-coupled via) that pushes the common-mode below the low-frequency band edge. The capacitively-coupled via based balun structure does not allow direct electrical connection to the PUMA radiating arms, thus eliminating the possibility of low-frequency loop resonances at the low-frequency band edge. In addition, embodiments of the PUMA array naturally enhance capacitive coupling between the PUMA arm tips, thus increasing the bandwidth potential of the array. Certain aspects and embodiments add additional degrees of freedom (metallic plate and ribs) to increase the inter-element coupling and also relax manufacturing tolerances to improve scalability to higher frequencies. The introduction of the metallic plate 5 (shown in FIGS. 1B and 2A-C, for example) serves as a significant source of coupling to the PUMA arms that can oversaturate the required amount of coupling necessary for the desired bandwidth. As a result, stringent parameters used to attain higher inter-element coupling in conventional PUMA arrays can be relaxed, such as the distance between metallic traces (cross-polarized arm coupling) and dielectric layer thickness. The capacitance between the feed-line rib conductors is also an important aspect that, in conventional PUMA arrays, becomes difficult to synthesize at higher frequencies because of via-to-via drill spacing and via length-to-diameter aspect ratio manufacturing limitations. Embodiments of the novel PUMA array disclosed herein overcome this issue by introducing tightly-coupled traces as junctions along the feed conductors (ribs 8 and 9) as shown in FIGS. 1B and 2A that compensate for larger distances between coupled feed lines. As a result, construction of the PUMA at EHF becomes more practical by continuing to satisfy the standard microwave fabrication procedures, even at frequencies above 40 GHz.

Thus, aspects and embodiments of the PUMA array may mitigate the catastrophic common-mode with the inclusion of a balun, and may allow maximum bandwidth potential for the given array volume to be harnessed, at even higher frequencies. Simulations of embodiments of the PUMA disclosed herein have demonstrated a 6:1 bandwidth near 22 GHz with VSWR <2 at broadside, VSWR <2.8 when scanned out to $\theta=45°$, and diagonal-plane cross-polarization levels below 10 dB when scanned out to $\theta=45°$. This allows the elements to be used in an array capable of very wide scan with a 143% bandwidth. Further, embodiments of the PUMA arrays disclosed herein may retain the practical mechanical benefits of conventional PUMA arrays (e.g., modularity, direct unbalanced feeding, planar fabrication, low-profile, etc.) while doubling the bandwidth (from 3:1 to 6:1, for example) to yield a fractional bandwidth of 143% (as opposed to 100%). The fully planar topology of certain embodiments may also allow for standard microwave/millimeter-wave fabrication to produce low-cost, low-profile (λ/2), modular UWB-ESAs with a competitive 6:1 bandwidth.

It is to be appreciated that embodiments of the methods and apparatuses discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Certain aspects and embodiments include a printed planar phased array with a 6:1 instantaneous bandwidth that satisfies standard microwave fabrication tolerances up to approximately 45 GHz. In one example, the primary radiating elements of the electronically steered array (ESA) are horizontal arms 6 and 7 periodically placed from each other. The so-called "arms" of the radiator in one embodiment are planar printed artwork with a functional shape. These arms could also be called legs, traces, fins, leafs, shapes, etc. The radiators can be interpreted as dipoles, but this is not the only interpretation. In certain embodiments the radiators 16 are arranged in an orthogonal dual-offset dual-polarization configuration, as shown in FIGS. 2A and 3B. However, in other embodiments, the radiators 16 can be arranged in a single-polarization configuration, as shown in FIG. 3A, for example. In one example, the overall profile of the array is on the order of one quarter to one half of a wavelength at the high-frequency band-edge.

Referring again to FIGS. 1B and 2A-C, according to one embodiment, a plated via 4 is used to directly connect PUMA arm 7 to the ground plane 1, and plated via 3 connects the other PUMA arm 6 to the inner-conductor of a standard RF connector 19, as discussed above. Together, metallic vias 3 and 4 function as vertical transmission lines to excite the radiating printed arms 6 and 7. The radii and positions of all vias can be modified for tuning and fabrication purposes. As discussed above and shown in FIG. 2A, the PUMA can be configured in a dual-polarization arrangement such that certain ones of the elements (including plated vias 3*a*, 4*a*, and arms 6*a*, 7*a*) are oriented for horizontal polarization (H-pol) and others (including vias 3*b*, 4*b*, and arms 6*b*, 7*b*) are oriented for vertical polarization (V-pol).

According to certain embodiments, the metallic plate 5 is registered proximate the PUMA arms spaced at a distance specific to each particular embodiment and frequency operation. In one embodiment, the plate 5 of arbitrary shape is printed at the opposite side of layer 13 that is centered at the tip of the four orthogonal PUMA arms 6*a*, 6*b*, 7*a*, and 7*b*. This plate 5 couples with PUMA arms 6*a*, 6*b*, 7*a*, and 7*b* by any one of several mechanisms (e.g., capacitively, directly, inductively, etc.). In one embodiment the plate is capacitively coupled by relative placement; however this may be done with other mechanisms (e.g. lumped elements). The plurality of PUMA arms may be printed on a single layer atop a multilayer PCB 10, 11, 12, and 13 and separated approximately a quarter wavelength at the highest frequency from the ground plane 1 of the multilayer PCB stack. One or two superstrate layers 14 and 15 may be bonded atop of the dipoles to protect them and to improve the impedance matching. Layers 17 are bondply (also called "prepreg") layers used to bond the different dielectric layers together. Similar to conventional PUMAs, the entire array PCB stack-up (10-15) may be perforated with periodically spaced cylindrical air holes that are drilled in the area formed between the orthogonal dipole arms 6 and 7. These holes can also be filled with other material besides air. The diameter of these perforations can be varied to control matching and the onset of dielectric surface waves with array scanning.

As shown in FIGS. 2B and 2C, horizontal metallic traces (ribs) 8 and 9 are printed in the vertical drill path of the feed line vias 3 and 4 on top of dielectric layer 10 and/or on top of dielectric layer 11, or beneath dielectric layer 12. The traces are oriented towards their adjacent counterpart to heighten capacitive coupling for tuning and fabrication purposes associated with the feed lines. The number and vertical positions of ribs 8 and 9 and their shape and dimensions may vary to control various electrical parameters and manufacturing aspects, where the number of ribs may range from zero to N (N being determined by required mechanical and electrical considerations).

Balanced radiating structures (most dipole-like radiators) are typically fed differentially over a wide bandwidth using baluns or hybrids that are external to the array. According to certain embodiments, elements may be fed directly with standard unbalanced RF transmission lines (coaxial cable, microstrip, stripline, etc.) due to the synergistic combination of the inventive metallic plate 5 connected to a grounded metallic plated via 2 that effectively function as an integrated wideband passive balun. This structure suppresses the common mode that would otherwise disrupt the radiation in the operating band by pushing it beneath the desired low-frequency band-edge. The position/radius of the plated via 2 and the position/shape/size of the plate 5 can be modified to adjust the common mode onset frequency. Compared to conventional PUMAs, no direct electrical connection between arms 6 and 7 and ground plane 1 is made in addition to plated feed via 4 and, thus, the common-mode is pushed beneath, rather than above, the operating band. Additionally, this structure eliminates the problem of the low-frequency loop mode that limits the low-frequency operation of conventional PUMAs, effectively enhancing the bandwidth. According to one embodiment, the basic operation principle behind the functionality of this structure closely mimics that of a ridged waveguide broadbanding itself by lowering its cut-off frequency with a capacitively-loaded metallic ridge. Along with the extra capacitive coupling introduced by the plate between dipole arms, embodiments of the PUMA disclosed herein may achieve a vast bandwidth increase (from 3:1 to 6:1) and allow relaxation of capacitive gap dimensions that would otherwise limit fabrication up to X-band.

Figure 20:
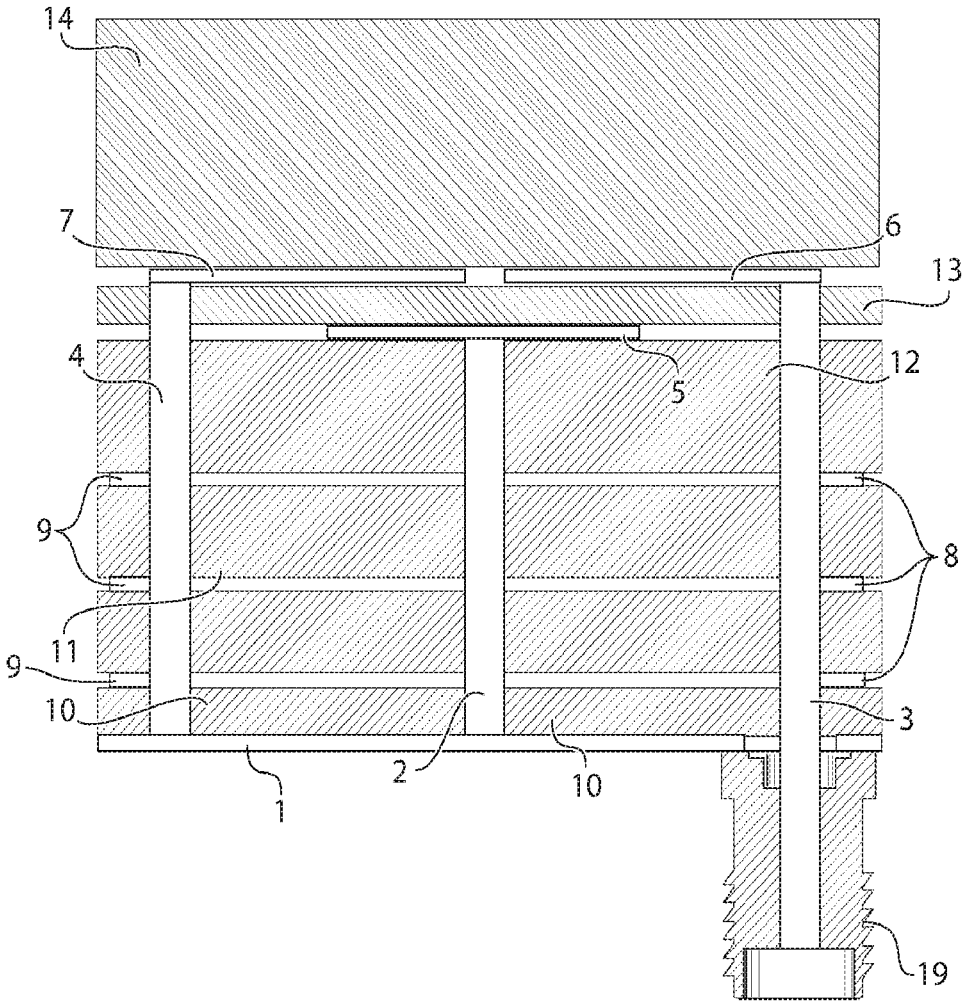
FIG. 20 is a cross sectional view of another example of a PUMA unit cell with the metallic plate and its via below the PUMA arm layer and with an additional dielectric layer beneath the arms to support an additional set of "ribs" according to aspects of the present invention.

Referring to FIGS. 5A-D, there is illustrated one example of an arbitrarily-shaped PUMA element within an array unit cell. In this example, four arbitrarily-shaped horizontal PUMA arms extend inwards within the unit cell towards the center, whereas the metallic plate 5 and its grounded via 2 are arbitrarily-positioned beneath the PUMA arm layer. The metallic plate 5 and its ground via 2 may be above or below printed arms 6 and 7, and do not necessarily have to be centered in the unit cell (they can individually/both vary in position/location). The PUMA arms 6 and 7 extend outwards from the feed line vias 3 and 4, with a gap between adjacent arms at the edges of the unit cell, shown as a dashed line representing the unit cell boundary. This gap allows for the modular fabrication and tile-based assembly of the array in the preferred embodiment. PUMA arms 6 and 7 may take any shape for tuning or fabrication purposes, including tapered profiles, linear segments, or any other curve, not limited to the shape or configuration illustrated in the drawings. The size and location of metallic vias 3 and 4 (the feed lines), which are connected near one end of each element for this example, may also vary. As discussed above, metallic via 2 connected to metallic plate 5 may also vary in size and location. Similarly, arbitrary configurations of horizontal metallic traces ("ribs") 8 and 9 may be used, for example, as shown in FIGS. 14A-J, where the shape and proximity between the ribs vary. Additionally, the number of sets along the metallic via feed lines 3 and 4 may vary. For example, FIG. 20 depicts an arrangement including three sets of ribs along the feed lines 3 and 4, as compared to the two sets shown in other Figures. In general, the number of ribs may range from zero to N, where N is determined by required mechanical and electrical considerations. All parameters may vary from one another to enable flexibility in tuning and fabrication.

As discussed above, the PUMA radiator arms 6 and 7 and metallic plate 5 may take on many shapes and positions for tuning and fabrication purposes. Additionally, arrangements of the dielectric layers 10-15 and their material properties may be varied to control impedance performance and wide angle scanning. Orthogonal dual-offset dual-polarized lattices are shown in many Figures; however, as discussed above, the array may be easily simplified to single-polarized versions with the removal of a set of orthogonal polarization from each periodic unit cell.

Figure 6:
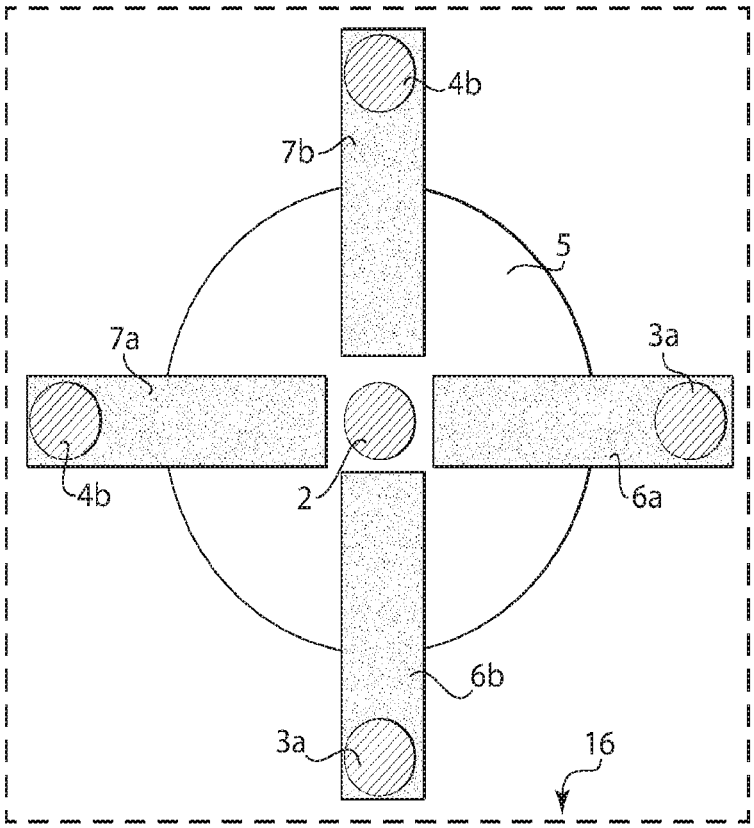
FIG. 6 is a top view of one example of a dual polarized PUMA unit cell with rectangular arms and circular plate centered at the arm tips with its via, according to aspects of the present invention.
Figure 7:
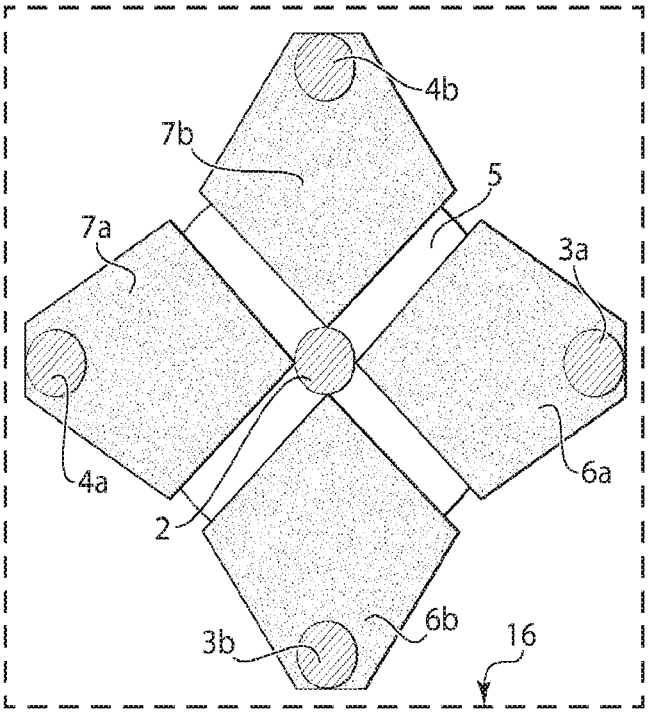
FIG. 7 is a top view of another example of a dual polarized PUMA unit cell with diamond-shaped arms and circular plate centered at the arm tips with its via, according to aspects of the present invention.
Figure 8:
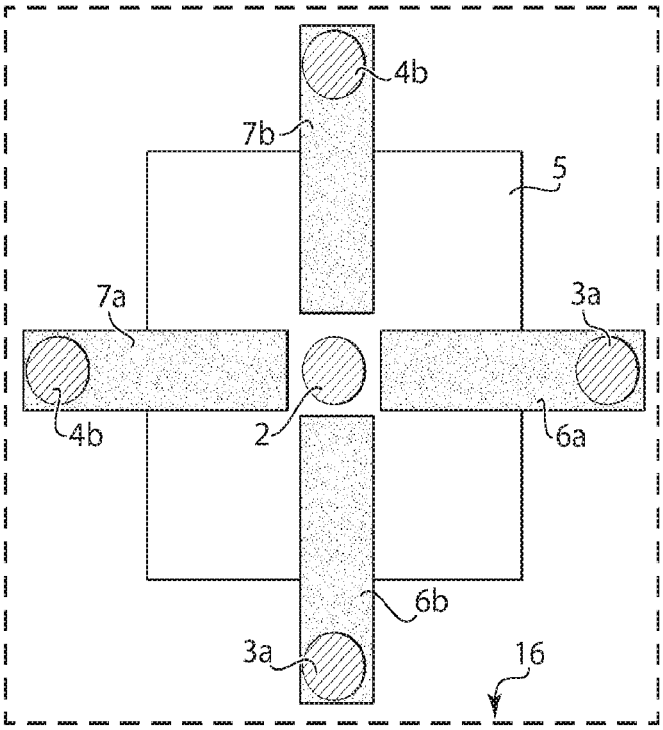
FIG. 8 is a top view of another example of a dual polarized PUMA unit cell with rectangular arms and square plate centered at the arm tips with its via, according to aspects of the present invention.
Figure 9:
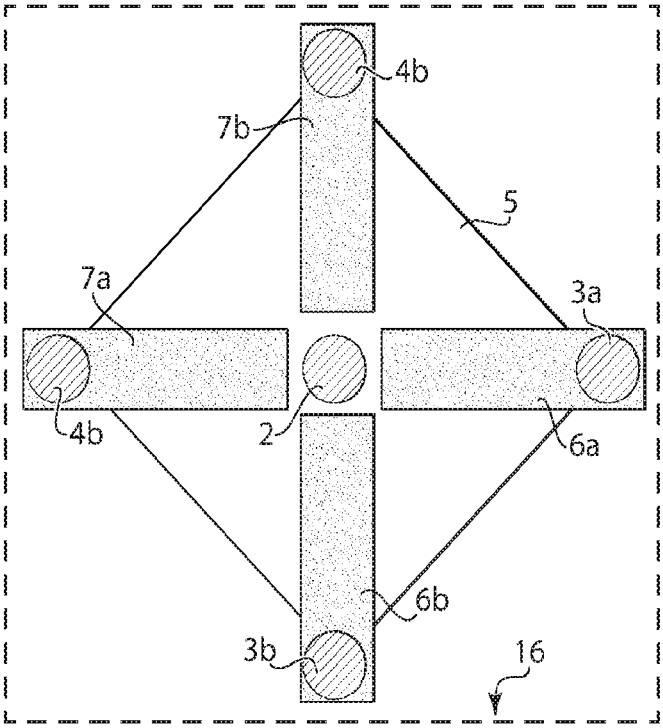
FIG. 9 is a top view of another example of a dual polarized PUMA unit cell with rectangular arms and rhombic plate centered at the arm tips with its via, according to aspects of the present invention.
Figure 10:
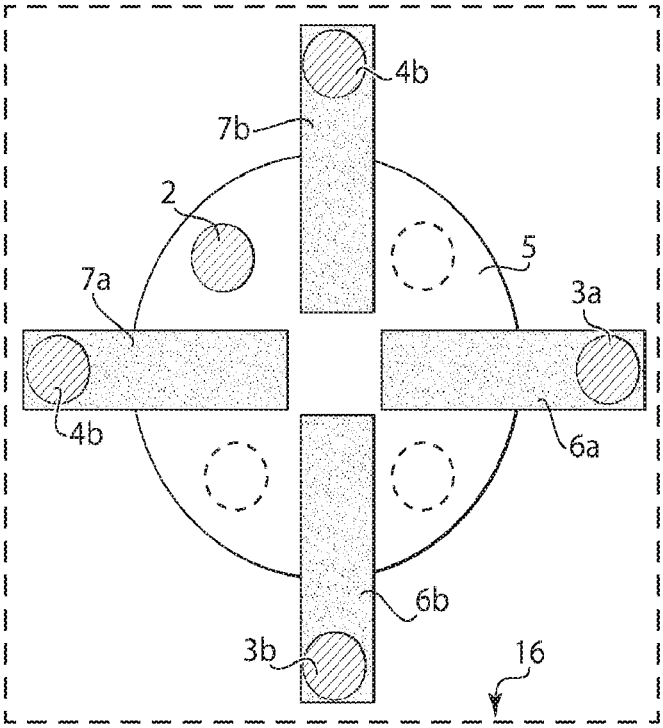
FIG. 10 is a top view of another example of a dual polarized PUMA unit cell with rectangular arms and circular plate centered at the arm tips with its via offset in one of four possible highlighted quadrants, according to aspects of the present invention.
Figure 11:
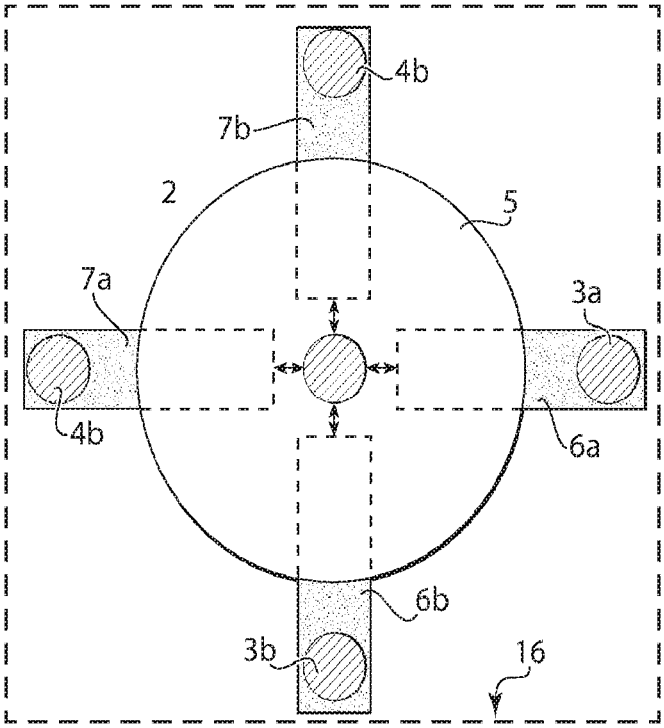
FIG. 11 is a top view of another example of a dual polarized PUMA unit cell with rectangular arms and circular plate centered at the arm tips and above the PUMA arm layer, according to aspects of the present invention.
Figure 12:
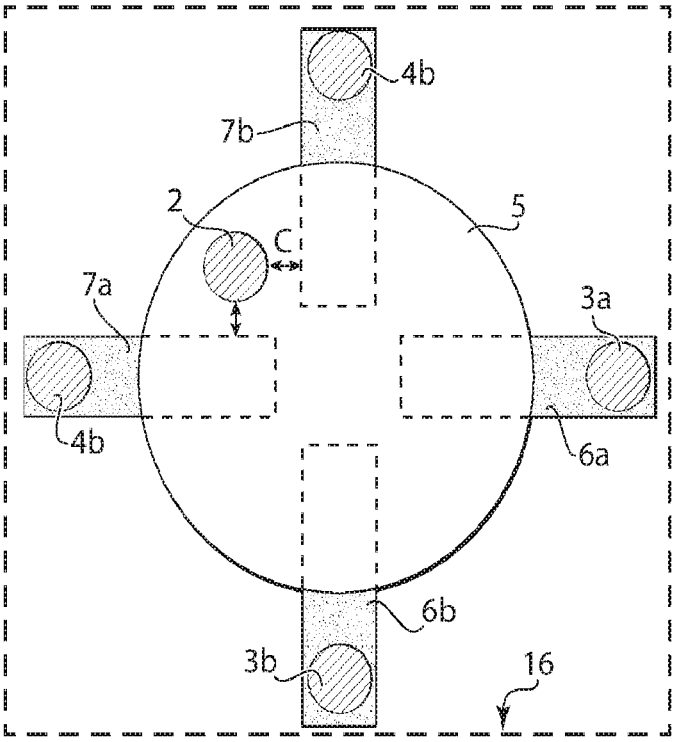
FIG. 12 is a top view of another example of a dual polarized PUMA unit cell with rectangular arms and circular plate centered at the arm tips and above the PUMA arm layer with its via offset towards the upper left (grounded feed lines), according to aspects of the present invention.
Figure 13:
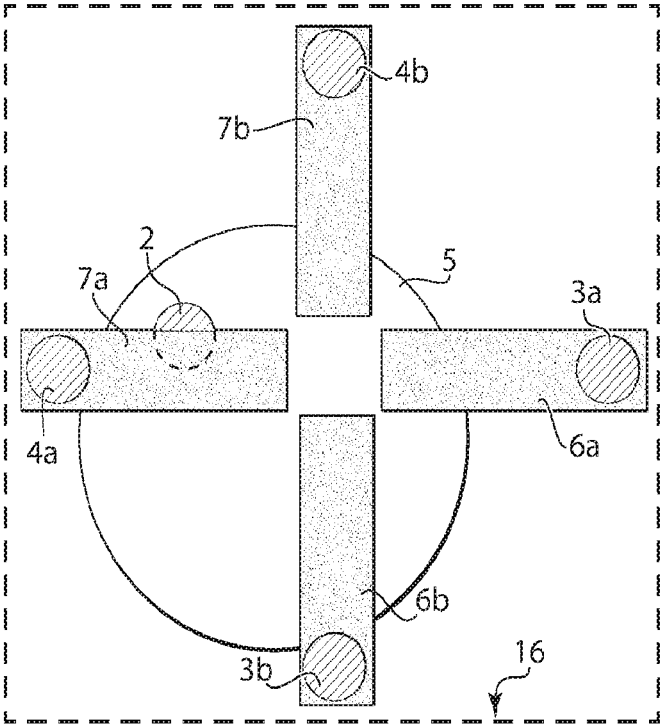
FIG. 13 is a top view of another example of a dual polarized PUMA unit cell with rectangular arms and circular plate offset from the center of the PUMA arm tips along with an offset via, according to aspects of the present invention.

Referring to FIG. 6, there is illustrated an example of one embodiment including symmetric rectangular-shaped PUMA arms 6 and 7 on the same layer and circular-shaped plate 5 spaced below the element layer centered at the location where orthogonal arms 6(*a*),(*b*) and 7(*a*),(*b*) meet. The via 2 that connects plate 5 to ground 1 is also centered at the same position. The width and shape of arms 6 and 7 may be modified to form wider transitions that have more tightly-coupled edges that heighten inter-element capacitance as shown in FIG. 7, for example, where PUMA arms 6 and 7 embody diamond-shaped structures as opposed to rectangular. The metallic plate 5 below the arms can also take on various shapes, with FIG. 8 and FIG. 9 depicting a square-shaped plate and rhombic-shaped plate, respectively. The plated via 2 connecting plate 5 to the ground plane 1 may be independently positioned anywhere upon the plate, for example being shifted away from its central position in FIG. 10 to any of the four quadrants highlighted upon the plate. Metallic plate 5 can also reside above the element layer, as shown in FIG. 11, where plated via 2 makes no direct connection with PUMA arms 6 and 7 and passes through clearance locations such as the central gap between element arm ends. In this embodiment, the metallization layers of dielectric 13 are interchanged. FIG. 12 illustrates another example of this configuration in which plated via 2 is offset from its center position as one such example of via position plurality. Furthermore, the position of the metallic plate 5 can vary in position, as shown in FIG. 13, for example. Thus, all parameters may vary in one structure to provide any specific combination for tuning and fabrication flexibility.

Figure 14A:
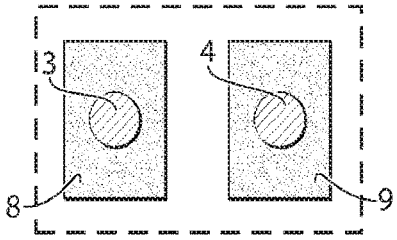
FIGS. 14A-J are top views illustrating various examples of feed line "ribs" according to aspects of the present invention.
Figure 14B:
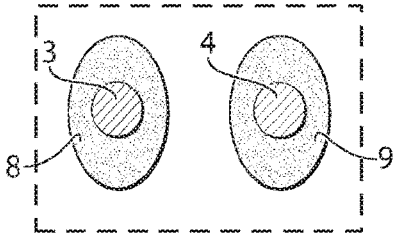
Figure 14C:
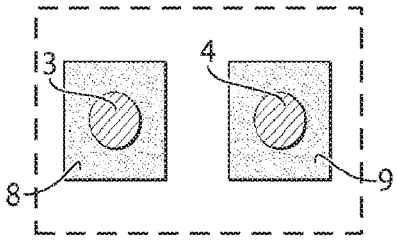
Figure 14D:
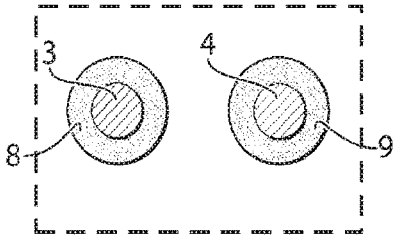
Figure 14E:
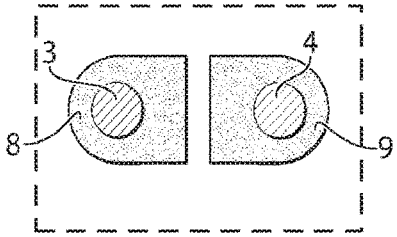
Figure 14F:
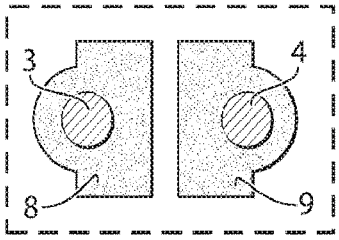
Figure 14G:
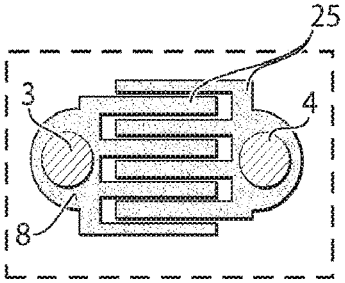
Figure 14H:
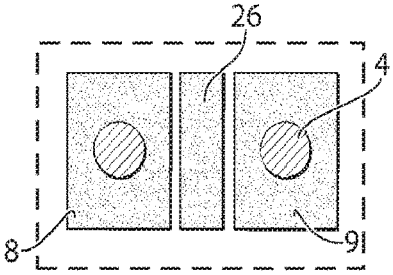
Figure 14I:
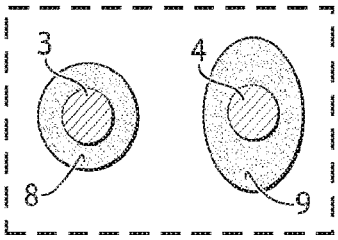
Figure 14J:
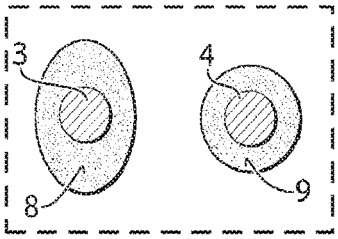
Figure 15:
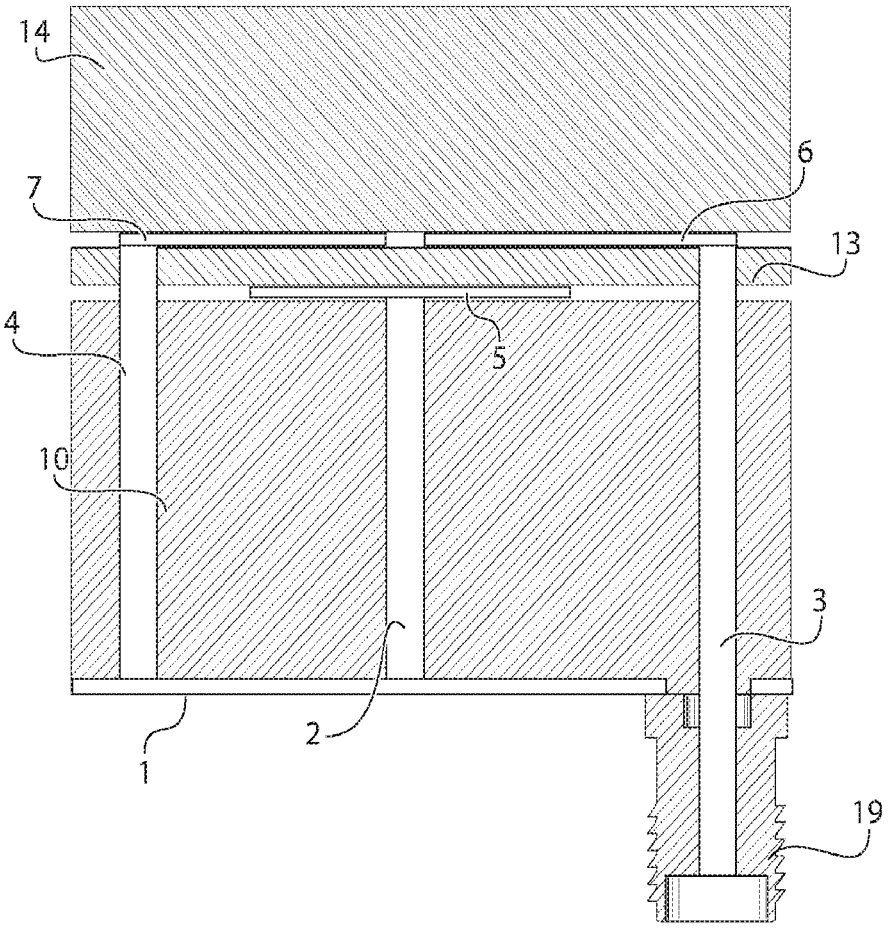
FIG. 15 is a cross sectional view of one example of a PUMA unit cell without "ribs" along the feed lines, according to aspects of the present invention.
Figure 16:
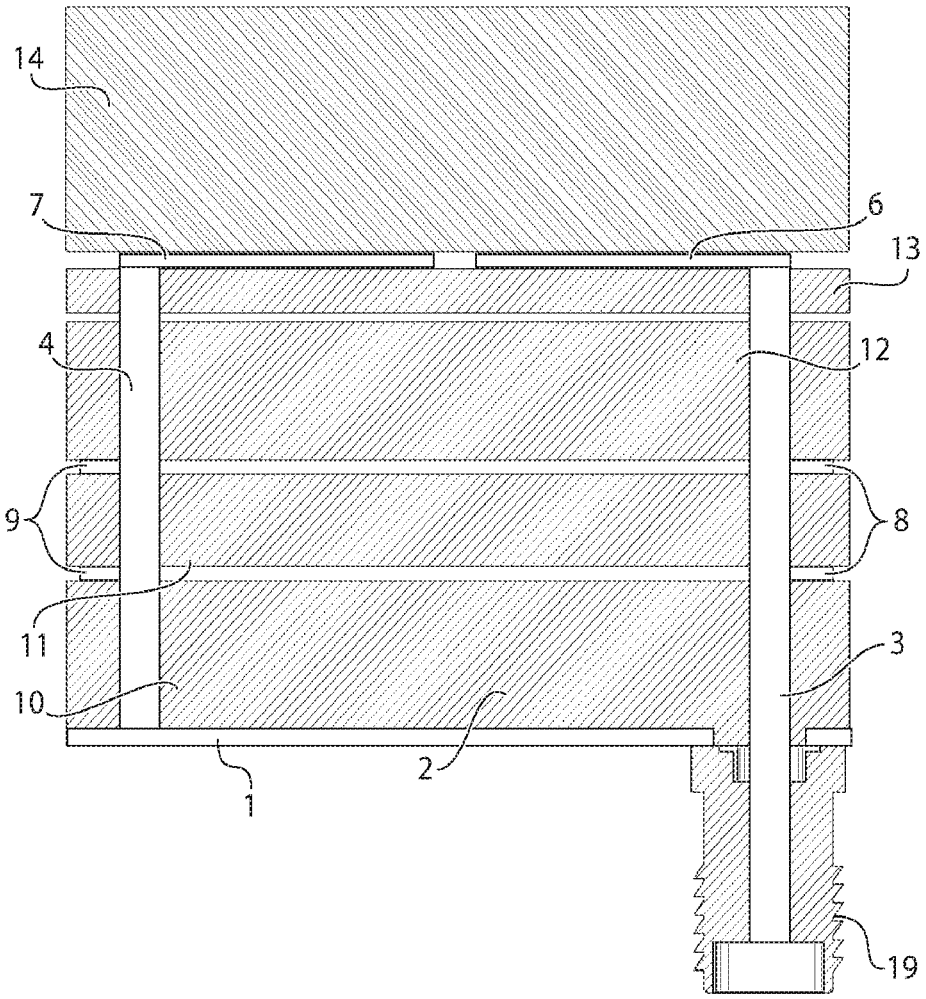
FIG. 16 is a cross sectional view of one example of a PUMA unit cell without a capacitive plate balun, according to aspects of the present invention.
Figure 17:
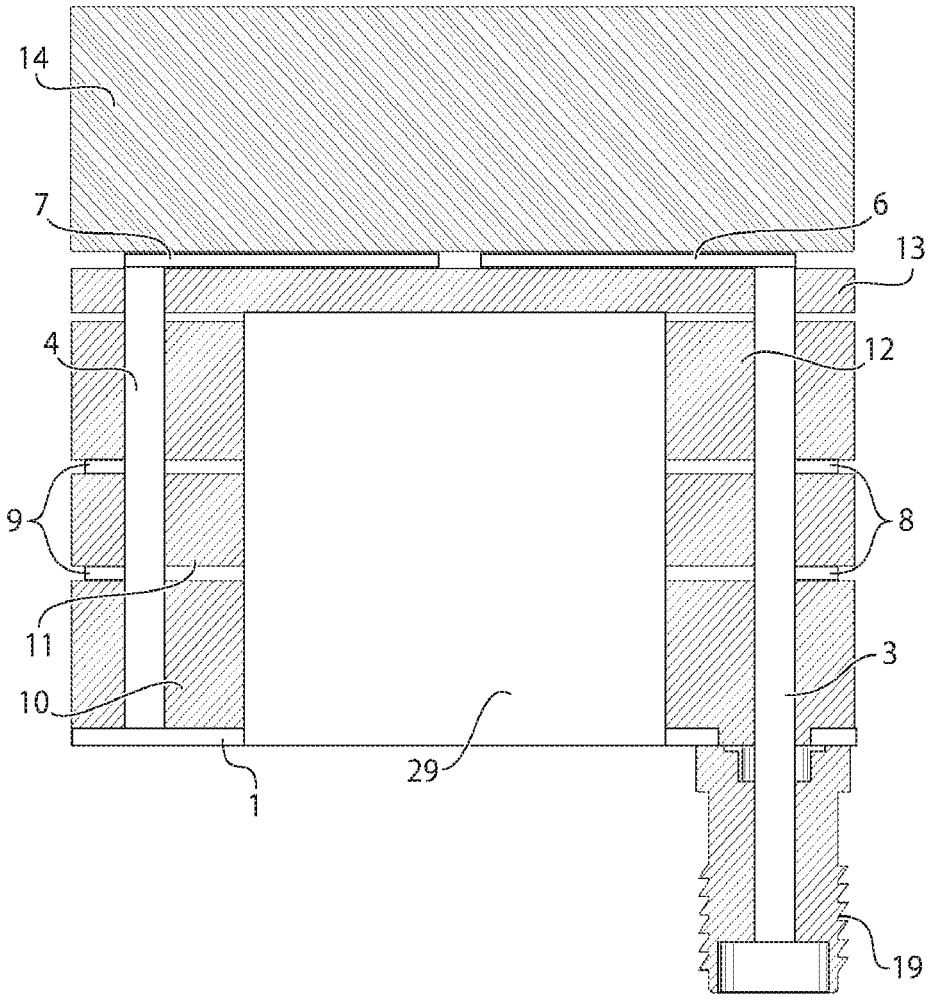
FIG. 17 is a cross sectional view of another example of a PUMA unit cell with an inserted metallic block replacing the capacitive plate balun, according to aspects of the present invention.

Referring again to FIGS. 5A-D, the horizontal metallic traces 8 and 9 that make connection with vertical metallic vias 3 and 4, respectively, may vary in shape, as shown, for example, in the various top views depicted in FIGS. 14A-J. Referring to FIG. 14G, interdigitated components 25 may be utilized to further heighten capacitive coupling. As shown in FIG. 14H, a coupled trace 26 may also be used to augment the capacitive coupling. There may be a plurality of the number of sets of the traces, and the number may vary with tuning and fabrication demands. For example, FIG. 20 shows an example including three sets of traces. Metallic traces 8 and 9 are oriented towards one another and printed upon layers 10, 11, and/or 12. Traces 8 makes connection with the excited feed line 3 upon drilling the via, as is similarly the case for similarly for trace 9 and the grounded feed line 4. The heightened capacitive coupling between feed lines due to the traces may provide a useful impedance tuning parameter and relaxes the via-to-via spacing manufacturing tolerances. In the case where the traces are not needed to meet electrical requirements, the design may be simplified, as shown for example in FIG. 15, where only dielectric layer 10 is necessary. In the case where the metallic via 2 and plate 5 are not needed for common-mode suppression, the design may be simplified as shown, for example, in FIG. 16. In addition, the metallic via 2 and plate 5 may be implemented using an inserted metal block 29, as shown, for example, in FIG. 17, in cases where this arrangement may be more mechanically convenient.

Figure 4:
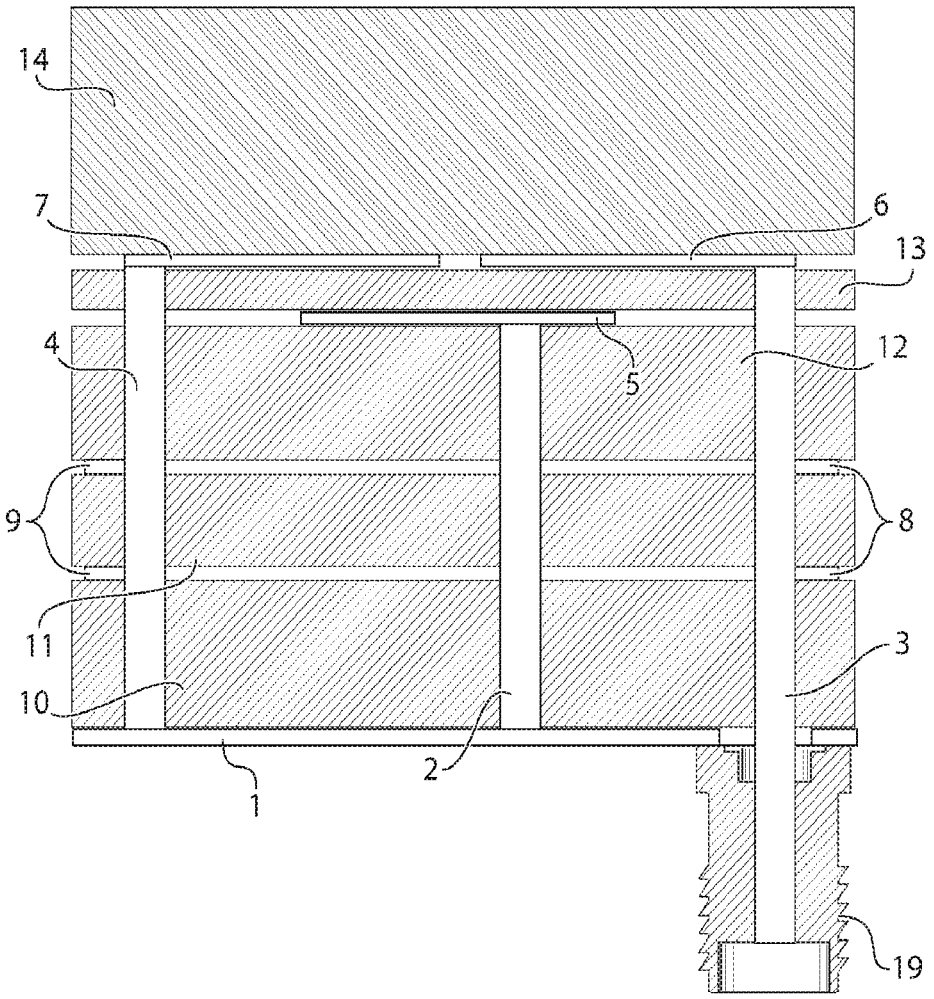
FIG. 4 is a cross-sectional view of one example of PUMA unit cell with five dielectric layers, according to aspects of the present invention.
Figure 5A:
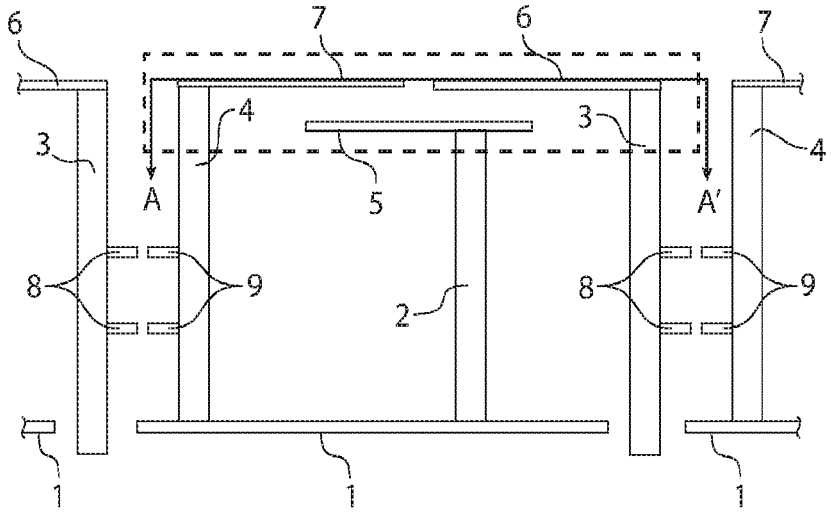
FIGS. 5A and 5B are cross-sectional views of one example of PUMA metalized components, according to aspects of the present invention.
Figure 5B:
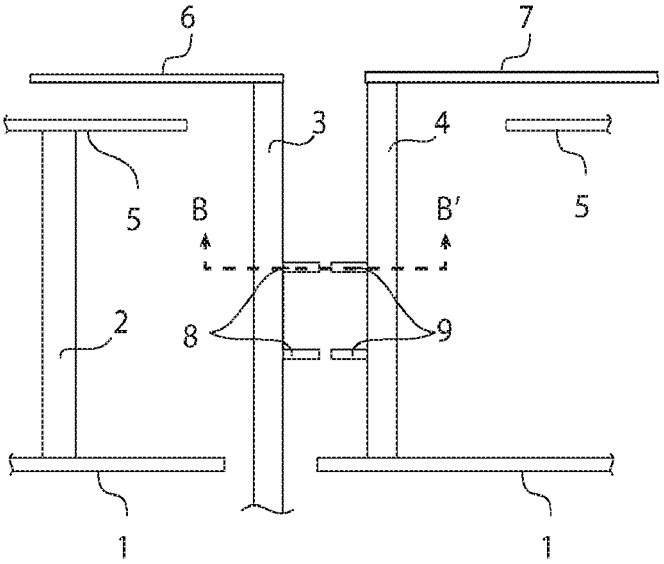
Figure 5C:
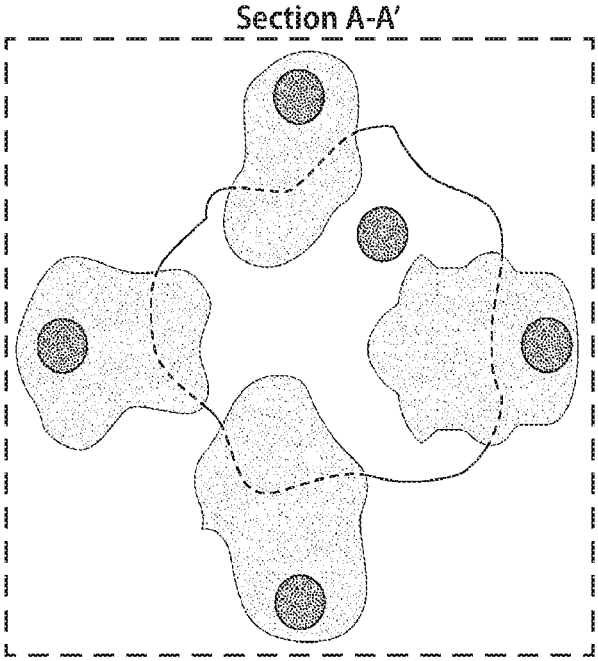
FIG. 5C is a top view of the junction between the arbitrarily shaped arms/plate taking along line A-A' in FIG. 5A, according to aspects of the present invention.
Figure 5D:
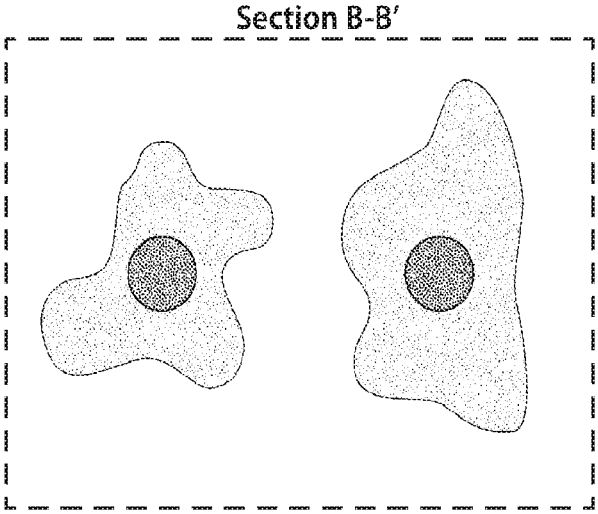
FIG. 5D is a top view of the junction between the feed line ribs taken along line B-B' in FIG. 5B, according to aspects of the present invention.
Figure 18:
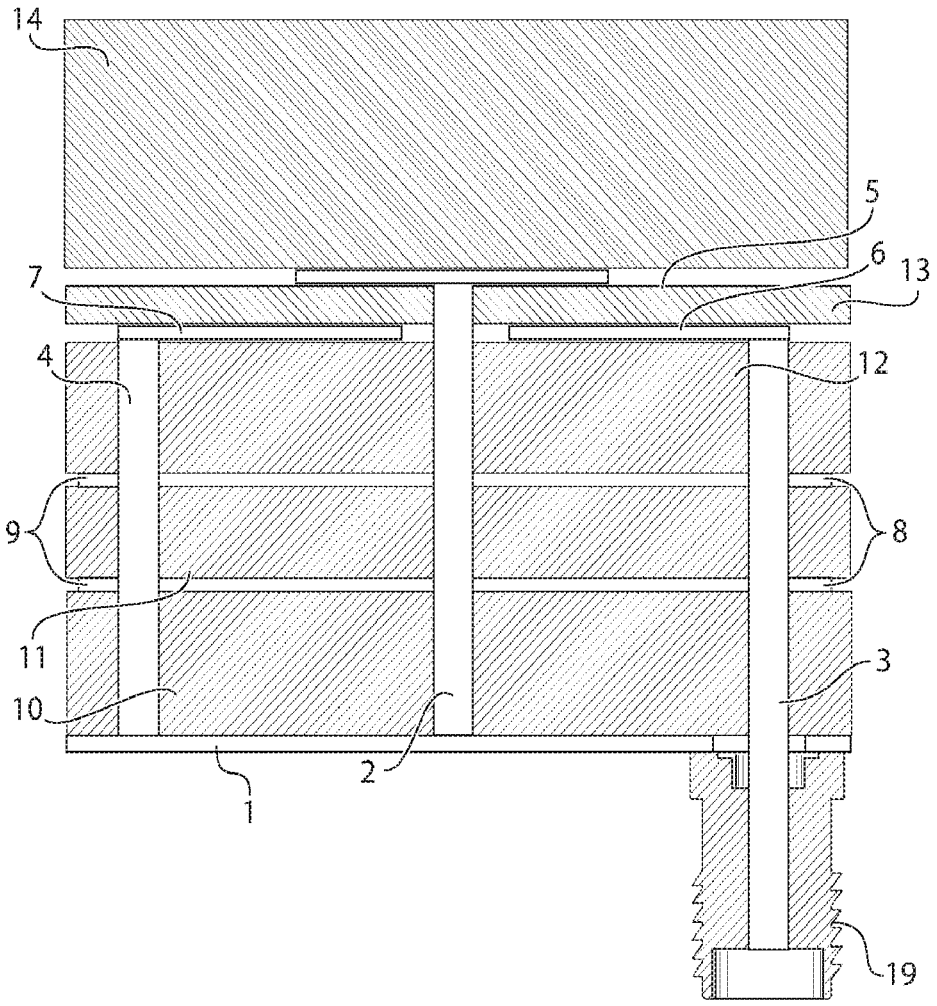
FIG. 18 is a cross sectional view of one example of a PUMA unit cell with the metallic plate and its via above the PUMA arm layer, according to aspects of the present invention.

One aspect of various embodiments is the dielectric layer stack-up, which provides mechanical support for the radiating elements 6 and 7 and the element feed lines 3, 4, 8, and 9 and the integrated balun structure 2, 5, in addition to contributing to tuning of the electrical behavior. The composition of the layers within the stack-up may vary depending upon desired electrical and fabrication considerations, for example. An example of an arrangement for a 6:1 PUMA array cross-section is shown in FIG. 4, in which five dielectric layers are utilized. In one example, layers 10, 11, and 12 are each approximately $\lambda/12$ thick at highband (totaling approximately $\lambda/4$, where $\lambda$ is the free space wavelength). In FIG. 4, layer 12 is seen to support the metallic plate 5, although it may also be printed on the bottom of layer 13. Metallic plate 5 is separated from the printed element arms 6 and 7 by dielectric layer 13. Layer 13 may be thinner relative to the other layers (e.g., $\lambda/25$ thickness at highband) to synthesize a high amount of inter-element coupling. Due to its thin thickness, in certain examples, layer 13 may be made of a simple prepreg bondply layer instead of a PTFE dielectric material. All of the layers of the stack-up may be made of foam, honeycomb material, or relatively low dielectric constant PTFE materials such as RT/Duroid 5880/5880LZ or RO3003 ($\in_r$=1-3). As these layers mechanically support the metallizations of the array, it may be preferable to use dielectric layers with low coefficients of thermal expansion (especially in the direction perpendicular to the layer) and capable of supporting plated vias and etched copper cladding. As will be appreciated by those skilled in the art, given the benefit of this disclosure, the layer position of metallic plate 5 and the element arms 6 and 7 can be interchanged, as shown in FIG. 18, for example, where the plated via 2 passes through a clearance between the dipole arm 6 and 7 tips.

Figure 19:
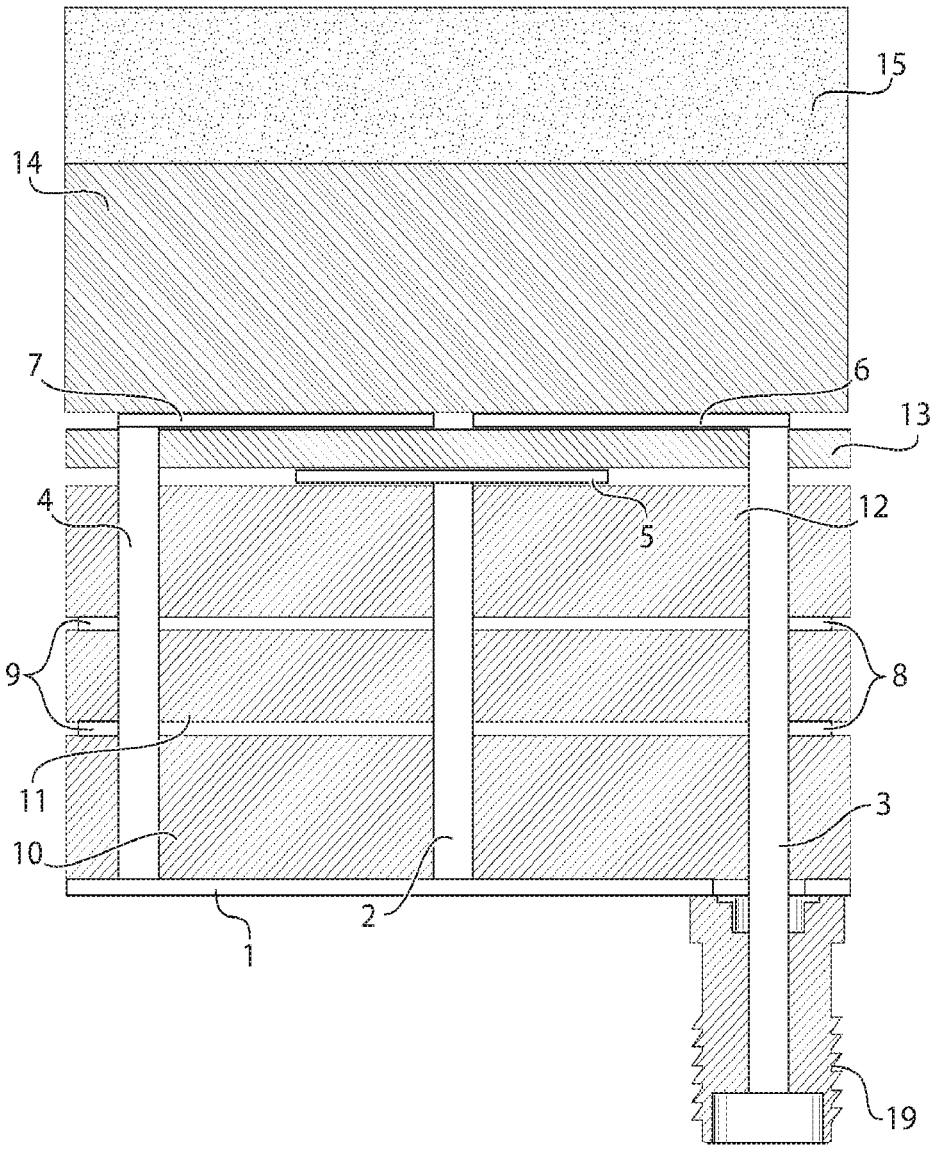
FIG. 19 is a cross sectional view of another example of a PUMA unit cell with the metallic plate and its via below the PUMA arm layer and with an additional superstrate layer, according to aspects of the present invention.

As discussed above, an important aspect of certain embodiments is that via 2 and plate 5 makes no direct electrical connection with dipole arms 6 and 7. Lastly, superstrate dielectric layer 14 may be loaded above the printed arms to serve as a broadside and wide angle impedance matching transformer. The characteristics of this layer may greatly vary in thickness (e.g., $\lambda/16$-$\lambda/4$ at highband) and permittivity (e.g., $\in_r$=1.96-10.2), and may largely depend upon the desired bandwidth and scanning requirements. Additional superstrate layers can be added, such as layer 15 in FIG. 19, for example, to provide additional degrees of freedom in tuning. In general, the number of superstrates may vary from zero to as many as required for the best matching and environmental protection. Desired electrical performance as well as potential harmful scan blindnesses, which can occur at certain scan angles if the dielectric layers become too thick, may be considered when selecting all layer thicknesses and relative permittivities. To assist in alleviating such scan blindnesses, periodically spaced cylindrical perforations (air holes) can be drilled throughout the periodic structure in the area formed between the orthogonal dipole arms 6 and 7.

Figure 21:
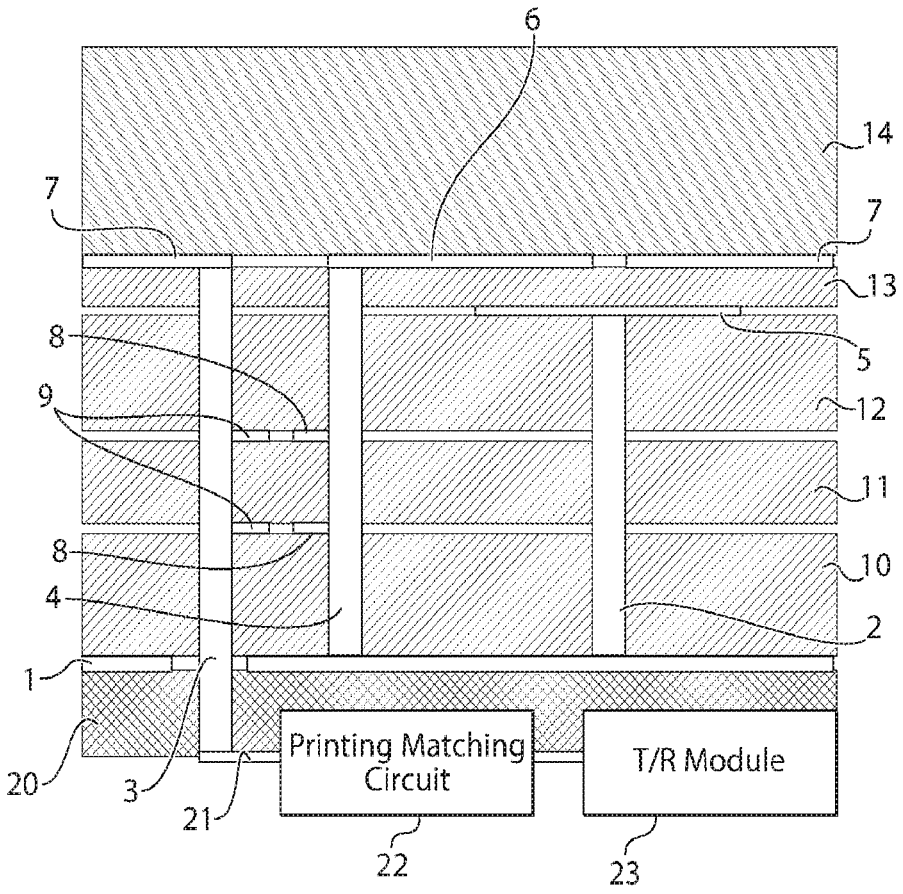
FIG. 21 is a cross sectional view of one example of a PUMA unit cell connected to a printed matching circuit and T/R module beneath its ground plane, according to aspects of the present invention.
Figure 22:
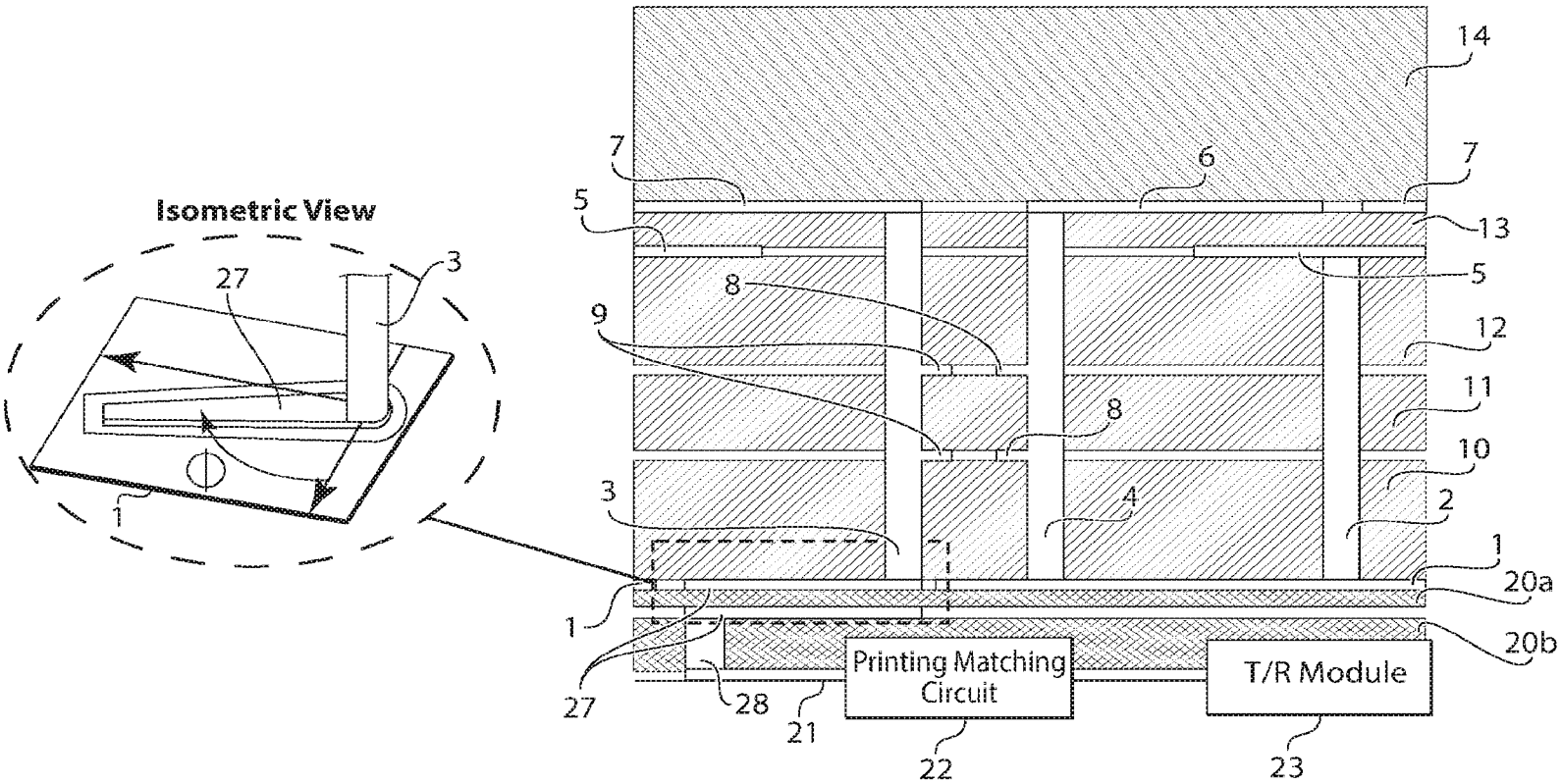
FIG. 22 is a cross sectional view of one example of a PUMA unit cell coupled to a planar circuit beneath its ground plane with a capacitively-coupled coplanar waveguide section, according to aspects of the present invention.

According to certain embodiments, the PUMA elements may be fed by a coaxial connector 19. FIG. 21 illustrates an example in which this connector is replaced by a microstrip line 21 located below the ground plane 1 printed upon the bottom of a dielectric layer 20. A matching circuit 22 may be connected to the microstrip line 21 to provide additional impedance matching. A direct connection to a T/R module 23 may also be provided. Thus, a fully planar feed network may be integrated beneath the ground plane 1 and may interface with RF modules. Although the feed network is depicted as a microstrip line in FIG. 21, it may alternatively be implemented using any planar microwave unbalanced line, such as stripline, coplanar waveguide, etc. Furthermore, the circuitry beneath the ground plane can be capacitively coupled (no direct connection) by sections 27*a* cut from the ground plane 1 to section 27*b* spaced beneath the ground plane, as shown, for example, in FIG. 22. Section 27*b* is connected to the microstrip line 21 (which may also be stripline, coplanar waveguide, etc.) through a plated via 28, which in turn is then again shown to be connected to a printed matching circuit 22 and T/R module 23 as a fully planar feed network with RF modules.

Referring again to FIGS. 2A and 2B, there is illustrated one embodiment of a dual-polarized arrangement. FIG. 2A illustrates a 2×2×2 tile cross-sectional view, and FIG. 2B illustrates a 3×3×2 tile top view. In this embodiment, the dielectric stack-up of the array includes 6 dielectric layers (without including prepreg bondply layers). In one example, dielectric layers 10, 11, and 12 total to a thickness of approximately $\lambda/4$ at highband and are made of a low dielectric constant PTFE material ($\in_r$=1-3). Layer 13 acts as a relatively low permittivity ($\in_r$=2-4) dielectric layer/spacer between the element layer and the plate layer with the availability of etched copper cladding and may typically be on the order of $\lambda/25$ at highband. In some examples, dielectric layers 14 and 15 have thicknesses that may vary between $\lambda/16$-$\lambda/8$ at highband and relative permittivities that may range from $\in_r$=1.2-10.2. In one example, dielectric layer 14 is approximately $\lambda/8$ at highband with a low relative permittivity constant ($\in_r$=1.2-2.2) and dielectric layer 15 is approximately $\lambda/16$ at highband with a high relative permittivity constant ($\in_r$=4.5-10.2). These layers synergistically provide broadside and wide angle impedance matching, and may also inherently behave as a radome for protection. Uniform cylindrical perforations 23 may be drilled through the entire dielectric stack-up to remove excess dielectric material post-manufacturing to help further alleviate the onset of scan blindnesses.

According to certain examples, the PUMA arms 6 and 7 are composed of linear segments to form a diamond shape that can be varied in width and size. The large area of the diamond shape synthesizes high inter-element coupling between cross-polarized elements and the metallic plate 5 below. In one example, the metallic plate 5 is circular for convenience of fabrication and symmetry; however, other shapes may be implemented, as discussed above. A plated via 2 connects from ground to the center of the plate, which may be located at the center of the arm end tips. Plated vias 3 and 4 respectively connect to arms 6 and 7 near the far edge of the arms, where plated via 3 drives the unbalanced excitation and plated via 4 connects to ground. In the illustrated example, two sets of two metallic traces 8 and 9 are small rectangular-like traces (such as are shown in FIG. 14F) oriented towards one another that can be varied in length/width to control added capacitive coupling between the feed line vias 3 and 4.

Figure 23A:
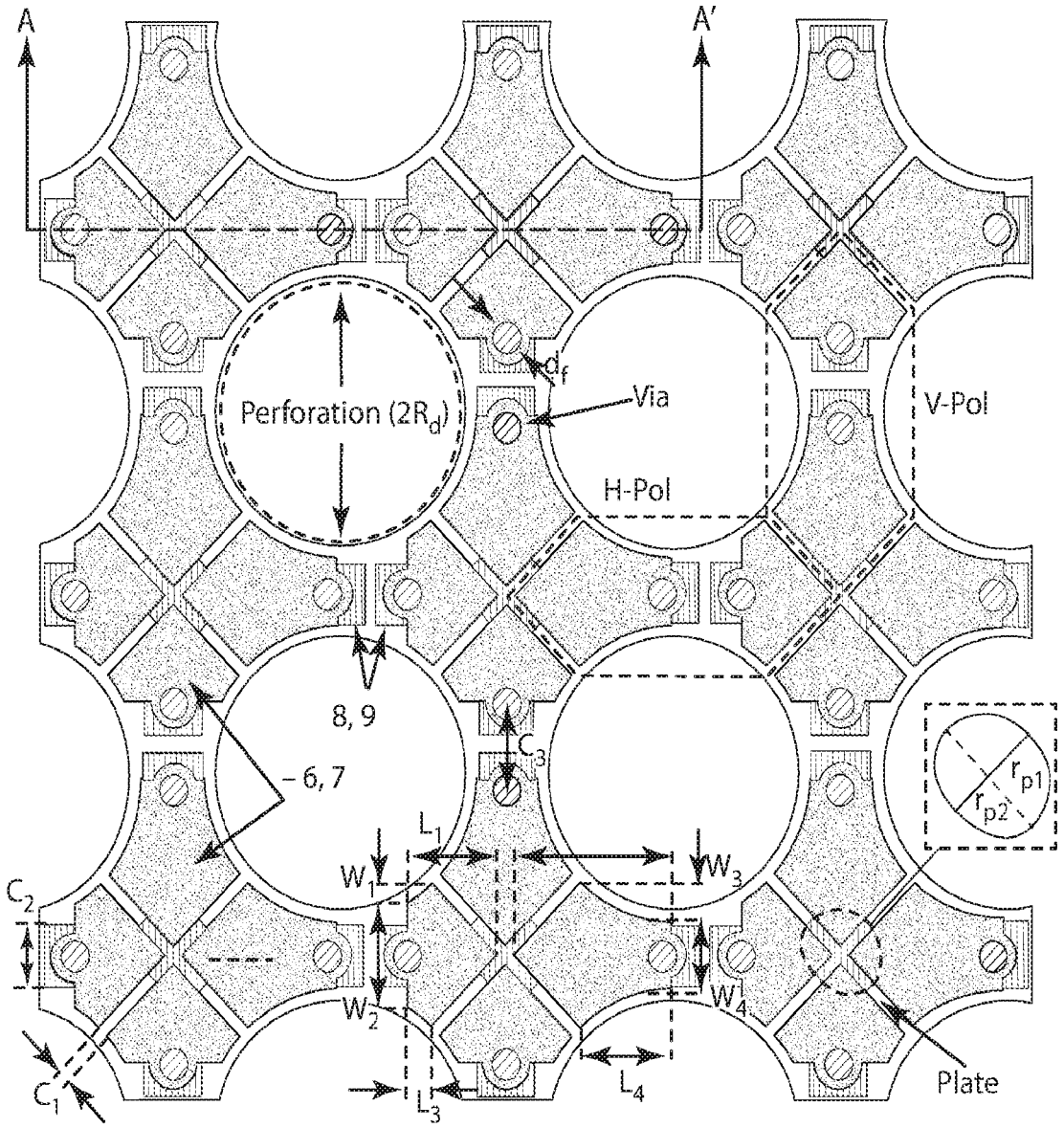
FIG. 23A is a top view of one example of a PUMA array with asymmetric dipole arms, and asymmetric metallic plate and its asymmetric via according to aspects of the present invention.
Figure 23B:
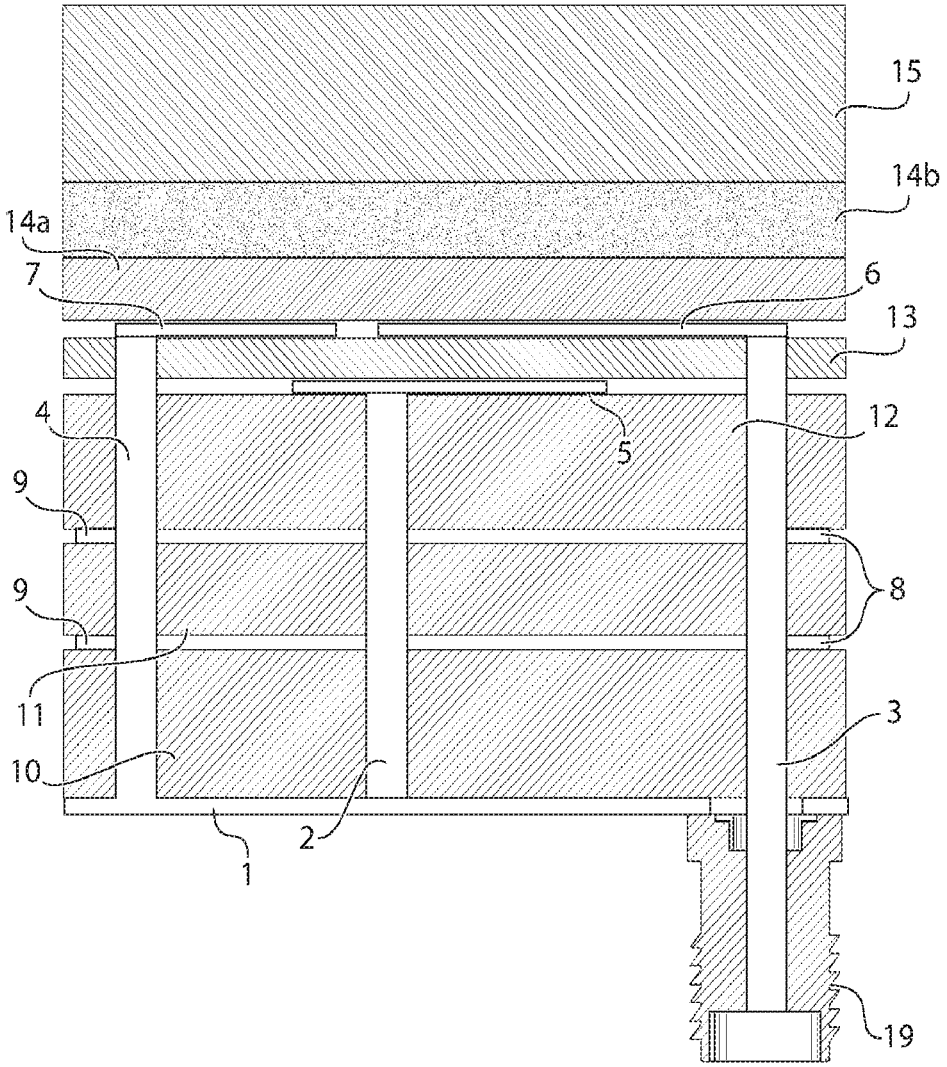
FIG. 23B is a cross sectional view of the a portion of the PUMA array of FIG. 23A taken along line A-A' in FIG. 23A.

According to another embodiment, the PUMA dipole arms 6 and 7 can be asymmetric, meaning that the two sides of the dipole arms are different in length. This arrangement can provide enhanced performance over the symmetric case. Referring to FIGS. 23A and 23B there is illustrated one example of a PUMA array with asymmetric dipole arms/segments. In particular, in this example the excited dipole arms 6 (also referred to as the fed or "hot" dipoles) are larger and longer than the grounded (passive) dipole arms 7. Implementing this asymmetric structure provides a tool to further improve impedance matching to the unbalanced feeding scheme. The example shown in FIG. 23B also includes a third superstrate layer, specifically layer 14 is split into two layers 14*a* and 14*b*, and a double ogive shaped plate 5 pinned in the ground 1 with an via 2 that is asymmetrically placed.

Figure 24:
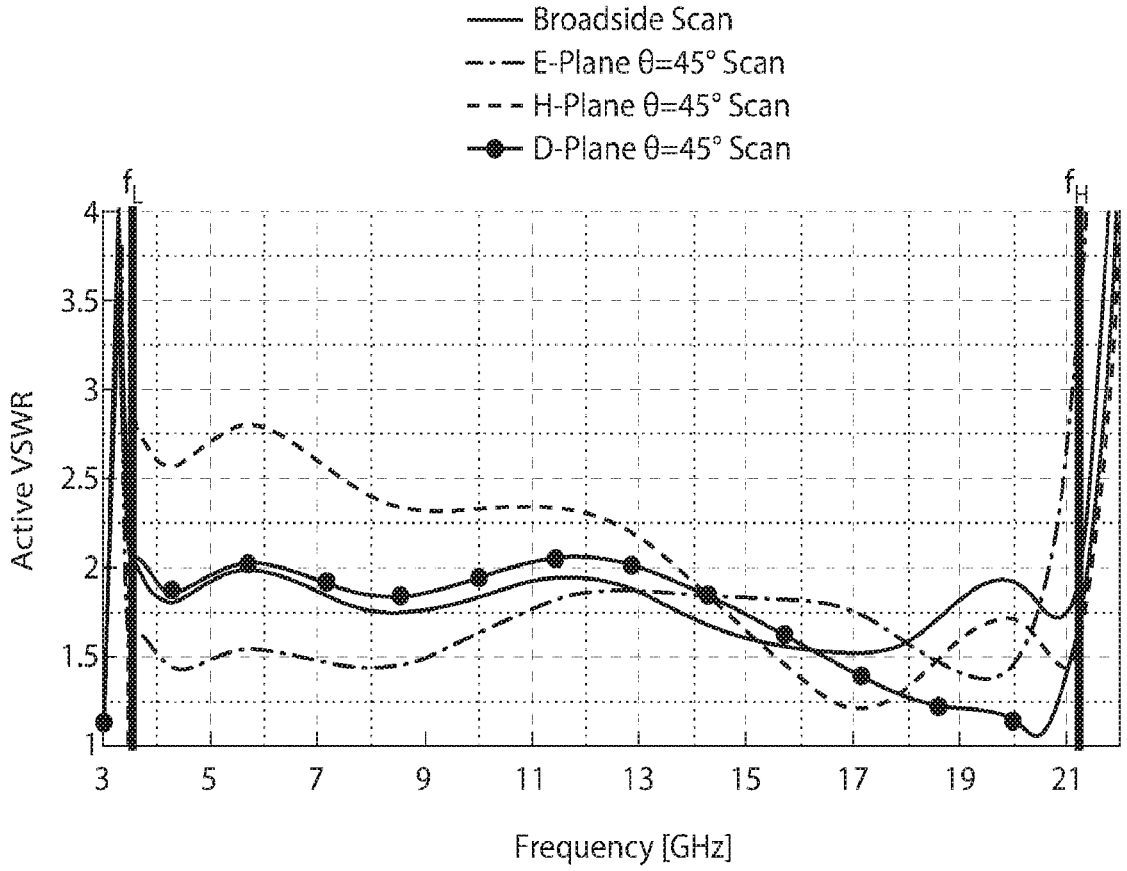
FIG. 24 is a graph illustrating active VSWR (referenced to 50Ω) of one example of a simulated PUMA array with broadside and scanned in its principal planes to θ=45°, according to aspects of the present invention.
Figure 25:
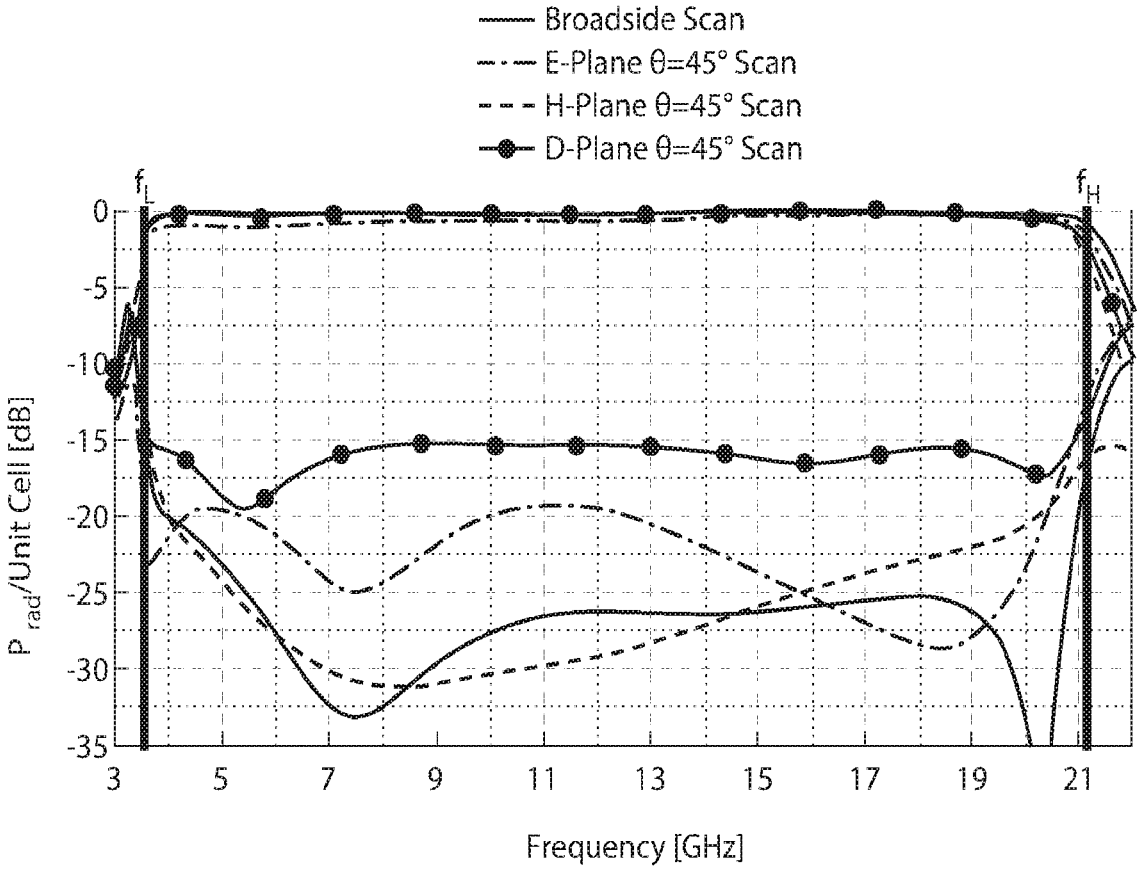
FIG. 25 is a graph showing broadside and E-/H-/D-plane θ=45° scanned co-/cross-polarization power radiated by a simulated unit cell within an infinite PUMA when one polarization is excited and the other is terminated in 50Ω, according to aspects of the present invention.

Results evaluating performance of one embodiment of the PUMA array, corresponding to the example shown in FIGS. 23A-B including asymmetric dipole arms, were obtained using industry-standard electromagnetic simulation software. The simulations assumed an infinite array environment referred to an unbalanced 50Ω characteristic impedance without any external components. FIG. 24 illustrates the resulting simulated VSWR at broadside and for E-/H-plane scanned out to θ=45°. The D-plane is omitted as it the average of the E-/H-plane results. The VSWR can be seen to be <2.05 for broadside and <2.7 for θ=45° over a 6:1 bandwidth, with the high-frequency band-edge being nearly 100% of the grating lobe frequency (minimal oversampling). Although the high frequency is tuned for 21.2 GHz, the potential for further extension into mm-waves is present. The simulated co-/cross-polarization levels for an element unit cell with one polarization excited and the other terminated in 50Ω are charted in FIG. 25. The co-polarization levels remain strong with less than 1 dB drop across the band and the cross-polarization remains mostly below 15 dB, with the exception of an increase near 13 dB at the low-frequency band-edge due to high port coupling at frequencies just below the low band edge. The use of asymmetric dipole arms 6, 7, achieves good performance operating over a 3.53-21.2 GHz (6:1) bandwidth out to 45 degree scans, without requiring a matching network, such as that shown in FIG. 22.

Thus, aspects and embodiments may provide an array having electrical and mechanical characteristics that may allow PUMA technology to further rival other UWB technologies by allowing for UWB arrays to be fabricated inexpensively and made more easily available to commercial applications. A PUMA array according to certain aspects and embodiments may allow for the following characteristics: UWB performance of 6:1 (143% fractional bandwidth) with VSWR <2; frequency scalability up to approximately 45 GHz; zero oversampling (high frequency is 100% of the grating lobe frequency); good scanning performance (VSWR <2.7 out to θ=45°); good polarization purity; completely planar construction; no external balun/circuitry or matching networks required; simple, low cost standard planar microwave or millimeter circuit fabrication; a conformal aperture; Modular construction; and/or low profile construction (total height approximately λ/2 at the grating lobe frequency).

As discussed above, conventional PUMA technology eliminated the need for external circuitry through the use of a balun that yielded a hard 3:1 bandwidth limitation due to additional grounding of the radiating arms. The balun was necessary in conventional PUMAs to prevent a disruptive common mode from developing on the feed lines of plated vias 3 and 4 (the same common mode that the CSA and FAA suppress using non-planar feed organizers and external circuitry), and prevented further enhancement of the PUMA in terms of bandwidth, which, despite its practical mechanical benefits, made the conventional PUMA less attractive than other UWB arrays that were much more expensive to fabricate and assemble.

In contrast, certain aspects and embodiments disclosed herein double the instantaneous bandwidth relative to conventional PUMA arrays from 3:1 to 6:1. Additionally, certain embodiments may provide a completely planar wideband array with 6:1 bandwidth and which may be scalable into mm-wave bands. The array according to various embodiments retains all of the practical mechanical benefits of conventional PUMA arrays, but may considerably enhance the electrical performance and frequency scalability by overcoming previous limitations through the use of capacitive-coupled via mechanism for common mode mitigation without bandwidth limitations, capacitive plate for enhanced low-end bandwidth and relaxed fabrication tolerances, feed line ribs for improved overall matching and relaxed fabrication tolerances, and/or capacitive-coupled feed line (no direct connection to feed components), as discussed above.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the invention. It is to be appreciated that embodiments of the methods and apparatuses discussed herein are not limited in application to the details of construction and the arrangement of components set forth in the description or illustrated in the accompanying drawings. The methods and apparatuses are capable of implementation in other embodiments and of being practiced or of being carried out in various ways. Examples of specific implementations are provided herein for illustrative purposes only and are not intended to be limiting. Accordingly, the foregoing description and drawings are by way of example only, and the scope of the invention should be determined from proper construction of the appended claims, and their equivalents.

What is claimed is:

1. A planar ultrawideband modular antenna (PUMA) array comprising an unbalanced RF interface;

a dual-offset dual-polarized lattice of horizontal dipole segments directly fed with the unbalanced RF interface; and a metallic plate capacitively-coupled to the lattice of horizontal dipole segments and pinned to a ground plane with a first plated via.

2. The PUMA array of claim 1 wherein the metallic plate is registered below the lattice of horizontal dipole segments.

3. The PUMA array of claim 1 wherein the dual-offset dual-polarized lattice of horizontal dipole segments includes a first plurality of horizontal dipole segments and a second plurality of horizontal dipole segments, each horizontal dipole segment of the first plurality of horizontal dipole segments being connected to the unbalanced RF interface by a second plated via, and each horizontal dipole segment of the second plurality of horizontal dipole segments being directly connected to the ground plane by a third plated via, the second and third plated vias providing a feed transmission line to excite the dual-offset dual-polarized lattice of horizontal dipole segments.

4. The PUMA array of claim 3 further comprising:

a multi-layer substrate having a first planar surface and an opposing second planar surface, the ground plane being disposed on the first planar surface and the first and second pluralities of horizontal dipole segments being disposed on the second planar surface such that the multi-layer substrate is sandwiched between the dual-offset dual-polarized lattice of horizontal dipole segments and the ground plane, the second and third plated vias extending through the multi-layer substrate.

5. The PUMA array of claim 4 wherein a thickness of the multi-layer substrate is selected such that the first and second pluralities of horizontal dipole segments are separated from the ground plane by a distance of approximately one quarter of a wavelength at a highest operating frequency of the PUMA array.

6. The PUMA array of claim 4 further comprising a plurality of superstrate dielectric layers disposed over the dual-offset dual-polarized lattice of horizontal dipole segments.

7. The PUMA array of claim 4 wherein the multi-layer substrate includes a first dielectric layer, a second dielectric layer disposed above the first dielectric layer, and a third dielectric layer disposed above the second dielectric layer, the first surface being a lower surface of the first dielectric layer, and the second surface being an upper surface of the third dielectric layer.

8. The PUMA array of claim 7 further comprising a first pair of ribs electrically connected to the second plated via and a second pair of ribs electrically connected to the third plated via, the first and second pairs of ribs being oriented to face towards one another, and each of the first and second pairs of ribs including a first rib disposed on an upper surface of the first dielectric layer and a second rib disposed on an upper surface of the second dielectric layer.

9. The PUMA array of claim 3 further comprising a first plurality of horizontal metallic ribs electrically connected to the second plated via, and a second plurality of horizontal metallic ribs electrically connected to the third plated via, the first and second pluralities of horizontal metallic ribs being oriented to face towards one another.

10. The PUMA array of claim 3 wherein each horizontal dipole segment of the first plurality of horizontal dipole segments is larger than each horizontal dipole segment of the second plurality of horizontal dipole segments.

11. The PUMA array of claim 1 wherein the metallic plate has a shape that is one of square, rectangular, circular, oval, and double tip asymmetric ogive.

12. The PUMA array of claim 1 wherein the metallic plate is centered below the lattice of horizontal dipole segments.

* * * * *